US007419756B2

(12) United States Patent
Yamashita et al.

(10) Patent No.: US 7,419,756 B2
(45) Date of Patent: Sep. 2, 2008

(54) DRY TONER, METHOD FOR MANUFACTURING THE SAME, IMAGE FORMING APPARATUS, AND IMAGE FORMING METHOD

(75) Inventors: Hiroshi Yamashita, Shizuoka (JP); Chiaki Tanaka, Shizuoka (JP); Tsunemi Sugiyama, Shizuoka (JP); Hiroshi Yamada, Shizuoka (JP); Kazuhito Watanabe, Kanagawa (JP); Shigeru Emoto, Shizuoka (JP); Masami Tomita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/734,895

(22) Filed: Apr. 13, 2007

(65) Prior Publication Data

US 2007/0184370 A1 Aug. 9, 2007

Related U.S. Application Data

(62) Division of application No. 10/247,639, filed on Sep. 20, 2002, now abandoned.

(30) Foreign Application Priority Data

Sep. 21, 2001 (JP) ..... 2001-288598

(51) Int. Cl.
*G03G 9/087* (2006.01)

(52) U.S. Cl. ..... 430/137.1; 430/109.4; 430/110.3; 430/110.4; 430/137.19

(58) Field of Classification Search ..... 430/110.4, 430/110.3, 109.4, 137.1, 137.19
See application file for complete search history.

(56) References Cited

U.S. PATENT DOCUMENTS

| | | | | |
|---|---|---|---|---|
| 5,547,802 | A | 8/1996 | Kawase et al. | |
| 6,077,636 | A | 6/2000 | Moriki et al. | |
| 6,096,468 | A | 8/2000 | Ohno et al. | |
| 6,148,163 | A | 11/2000 | Ito | |
| 6,159,647 | A * | 12/2000 | Anno et al. | 430/108.23 |
| 6,192,207 | B1 | 2/2001 | Yamamoto et al. | |
| 6,265,125 | B1 | 7/2001 | Anno et al. | |
| 6,326,115 | B1 | 12/2001 | Nakanishi et al. | |
| 6,360,068 | B1 | 3/2002 | Kinoshita et al. | |
| 6,363,229 | B1 | 3/2002 | Shiraishi et al. | |
| 6,395,443 | B2 | 5/2002 | Kuroda et al. | |
| 6,403,275 | B1 | 6/2002 | Kuramoto et al. | |
| 6,416,914 | B1 | 7/2002 | Nakamura et al. | |
| 6,468,706 | B2 | 10/2002 | Matsuda et al. | |
| 6,492,079 | B2 | 12/2002 | Shimada et al. | |
| 6,500,536 | B1 | 12/2002 | Yamada et al. | |
| 6,503,676 | B2 | 1/2003 | Yamashita et al. | |
| 6,548,216 | B2 | 4/2003 | Kawamura et al. | |
| 6,566,026 | B2 | 5/2003 | Watanabe et al. | |
| 6,596,449 | B2 | 7/2003 | Shimada et al. | |
| 6,660,443 | B2 | 12/2003 | Sugiyama et al. | |
| 6,682,866 | B2 | 1/2004 | Sugiyama et al. | |
| 6,737,210 | B2 | 5/2004 | Uchinokura et al. | |
| 6,756,175 | B2 | 6/2004 | Emoto et al. | |
| 6,800,412 | B2 | 10/2004 | Sugiyama et al. | |
| 6,824,945 | B2 | 11/2004 | Emoto et al. | |
| 6,835,519 | B2 | 12/2004 | Sugiyama et al. | |
| 6,852,462 | B2 | 2/2005 | Emoto et al. | |
| 6,853,822 | B2 | 2/2005 | Yano et al. | |
| 6,855,468 | B1 | 2/2005 | Yamamoto et al. | |
| 6,946,229 | B2 | 9/2005 | Suzuki et al. | |
| 6,947,692 | B2 | 9/2005 | Kondo et al. | |
| 7,005,223 | B2 | 2/2006 | Yamashita et al. | |
| 7,033,718 | B2 | 4/2006 | Tomita et al. | |
| 7,050,741 | B2 | 5/2006 | Koike et al. | |
| 7,056,635 | B2 | 6/2006 | Tanaka et al. | |
| 7,056,636 | B2 | 6/2006 | Tomita et al. | |
| 7,056,638 | B1 | 6/2006 | Tomita et al. | |
| 7,062,194 | B2 | 6/2006 | Yanagina et al. | |
| 7,074,535 | B2 | 7/2006 | Saito et al. | |

(Continued)

FOREIGN PATENT DOCUMENTS

| | | |
|---|---|---|
| JP | 7-152202 | 6/1995 |
| JP | 11-149179 | 6/1999 |

OTHER PUBLICATIONS

U.S. Appl. No. 10/652,505, filed Sep. 2, 2003, Murakami et al.
U.S. Appl. No. 11/622,477, filed Jan. 12, 2007, Tomita.
U.S. Appl. No. 11/672,319, filed Feb. 7, 2007, Shu et al.
U.S. Appl. No. 11/868,618, filed Oct. 8, 2007, Sugiyama et al.
U.S. Appl. No. 11/854,842, filed Sep. 13, 2007, Sugimoto et al.
U.S. Appl. No. 11/857,999, filed Sep. 19, 2007, Yamashita et al.

*Primary Examiner*—Janis L Dote
(74) *Attorney, Agent, or Firm*—Oblon, Spivak, McClelland, Maier & Neustadt, P.C.

(57) ABSTRACT

A dry toner contains fine particles having average sphericity of 0.93 to 0.99, a content of the fine particles having a particle diameter of 2 μm or less in the dry toner is 20% by number or less. A method for manufacturing a dry toner includes a process for dispersing in an aqueous medium containing water and a water-soluble organic solvent, a toner composition contained in an organic solvent by using fine solid dispersing agent; and a process for contracting volume of the dispersed toner composition. Further, the image forming apparatus having a photoconductor; a charger for charging the photoconductor; a light irradiator for irradiating the electrophotographic photoconductor to form a latent electrostatic image; a developer for developing the latent electrostatic image to form a developed image; and a transfer for transferring the developed image to a recording material, and the developer contains the dry toner abovementioned.

16 Claims, No Drawings

U.S. PATENT DOCUMENTS

| | | | |
|---|---|---|---|
| 7,074,541 | B2 | 7/2006 | Yamashita et al. |
| 7,083,890 | B2 | 8/2006 | Emoto et al. |
| 7,085,528 | B2 | 8/2006 | Shintani et al. |
| 7,103,301 | B2 | 9/2006 | Watanabe et al. |
| 7,122,286 | B2 | 10/2006 | Suzuki et al. |
| 7,129,013 | B2 | 10/2006 | Higuchi et al. |
| 7,130,564 | B2 | 10/2006 | Murakami et al. |
| 7,139,504 | B2 | 11/2006 | Yanagida et al. |
| 7,149,465 | B2 | 12/2006 | Amemiya et al. |
| 7,157,199 | B2 | 1/2007 | Emoto et al. |
| 7,157,201 | B2 | 1/2007 | Tomita et al. |
| 7,158,730 | B2 | 1/2007 | Watanabe et al. |
| 7,163,775 | B2 | 1/2007 | Takada et al. |
| 7,208,256 | B2 | 4/2007 | Tanaka et al. |
| 2002/0025184 | A1 | 2/2002 | Ishikawa et al. |
| 2003/0027066 | A1 | 2/2003 | Yamashita et al. |
| 2003/0055159 | A1 | 3/2003 | Yamashta et al. |
| 2003/0096185 | A1 | 5/2003 | Yamashita et al. |
| 2003/0134220 | A1 | 7/2003 | Emoto et al. |
| 2004/0115551 | A1 | 6/2004 | Sugiyama et al. |
| 2004/0131961 | A1 | 7/2004 | Watanabe et al. |
| 2004/0137356 | A1 | 7/2004 | Tomita et al. |
| 2004/0157146 | A1 | 8/2004 | Tomita et al. |
| 2004/0175641 | A1 | 9/2004 | Nanya et al. |
| 2004/0229147 | A1 | 11/2004 | Higuchi et al. |
| 2004/0259013 | A1 | 12/2004 | Ohtani et al. |
| 2004/0265721 | A1 | 12/2004 | Matsuoka et al. |
| 2005/0002705 | A1 | 1/2005 | Shintani et al. |
| 2005/0003288 | A1 | 1/2005 | Sugiyama et al. |
| 2005/0042534 | A1 | 2/2005 | Tanaka et al. |
| 2005/0079433 | A1 | 4/2005 | Watanabe et al. |
| 2005/0084271 | A1 | 4/2005 | Koike et al. |
| 2005/0112488 | A1 | 5/2005 | Yamada et al. |
| 2005/0164112 | A1 | 7/2005 | Ohki et al. |
| 2005/0232666 | A1 | 10/2005 | Ojimi et al. |
| 2006/0133837 | A1 | 6/2006 | Shimojo et al. |
| 2006/0154168 | A1 | 7/2006 | Tomita et al. |
| 2006/0251979 | A1 | 11/2006 | Watanabe et al. |
| 2007/0015077 | A1 | 1/2007 | Yamahita et al. |
| 2007/0020546 | A1 | 1/2007 | Emoto et al. |
| 2007/0054210 | A1 | 3/2007 | Ohki et al. |
| 2007/0059626 | A1 | 3/2007 | Inoue et al. |
| 2007/0059628 | A1 | 3/2007 | Tanaka et al. |
| 2007/0065183 | A1 | 3/2007 | Tomita |

* cited by examiner

DRY TONER, METHOD FOR MANUFACTURING THE SAME, IMAGE FORMING APPARATUS, AND IMAGE FORMING METHOD

BACKGROUND OF THE INVENTION

1. Field of the Invention

The present invention relates to a toner for use in a developer for developing electrostatic images in electrophotography, electrostatic recording, electrostatic printing and the like, and a method for manufacturing the same. More particularly, the present invention relates to a toner for electrophotography utilized in copy machines, laser printers and normal paper facsimiles using the direct or indirect electrophotography developing method, and a method for manufacturing the same. Also, the present invention relates to a toner for electrophotography used in full color copy machines, full color laser printers, full color normal paper facsimiles, and the like using the direct or indirect electrophotographic multi-color image developing method, a method for manufacturing the same, and a method for developing using the toner.

2. Description of the Related Art

Developers used in electrophotography, electrostatic recording, electrostatic printing and the like are developed by a process for developing. For example, a developer is adhered to an image carrier such as a photoconductor upon which an electrostatic image is formed, transferred from the photoconductor to a transferring medium such as a transferring paper by the transferring process and fixed on the paper by the fixing process. As the developer for developing the electrostatic image formed on the surface carrying a latent image, two-component developer comprising a carrier and a toner and one-component developer which does not require a carrier such as magnetic toner and non-magnetic toner are known.

Conventionally, dry toners which are used in electrophotography, electrostatic recording and electrostatic printing are prepared by melt-kneading a toner binder such as styrene resins, polyester and the like along with a colorant, followed by pulverization.

In order to obtain an image with high dignity and high quality, it has been attempted to reduce the particle diameter of toners. However, since the toner particles produced by the conventional admixing or roll-mixing, the pulverization method have indefinite shapes and are mixed with ultrafine particles, and, even though a classification process is applied, it still has a problem not to sufficiently classify toner particles as adhered to the toner with the desired particle diameter, because the ultrafine particles are highly adhesive.

The toner particles having indefinite shapes can also be further pulverized by stirring along with a carrier in a developing unit of an image forming apparatus, or by the contact stress with a developing roller, a toner supplying roller, a layer thickness regulating blade or a friction charging blade, when used as a one-component developing agent, thereby producing ultrafine particles. These ultrafine particles can be adhered or fixed on a carrier or mechanical elements, causing problems. Also, fluidity-imparting agents can be embedded in the toner surface, thereby causing deterioration in the image quality.

Also, the toner particles having indefinite shapes are poor in fluidity as powders and filling capability into a toner container and may need a large amount of a fluidity-imparting agent and impede with the compactness of the toner particles in the toner container. Therefore, the advantage of the small diameter particle cannot effectively utilized. Further, there is a limit in the preparation by the pulverization and thus, it is not possible to provide smaller diameter particles.

In addition, since the process for transferring the image formed by multi-color toner from a photoconductor to a transferring medium or paper in order to form a full color image is complex and the indefinite shape of the pulverized toner particles lead to poor transferring property, image omission may occur and a large amount of toner should be used to compensate such image omission.

Therefore, there are demands for prevention of durability from deterioration of ultrafine particles, production of high quality image without image omission and enhancement of transferring efficiency to lower the running cost by reducing the amount of the used toner. If the transferring efficiency is high, a cleaning unit for removing non-transferred toner from a photoconductor or transferring medium is not needed, the small-size apparatus and low cost can be realized, and waste toner can be reduced. In order to solve these problems caused by the indefinite shape of toner particles, various methods for producing a spherical toner have been researched and suggested.

Methods for producing a toner by suspension polymerization have problems in that only spherical toner particles are produced, apparatuses for removing remaining toner particles on a photoconductor or transferring medium (e.g., cleaning blade or cleaning brush) cannot sufficiently remove the spherical toner particles, causing cleaning failure. Also, due to the spherical shape, the toner surface is exposed, in all directions, to contact with charging members such as a carrier or charging blade, added materials and a charge controlling agent existing in the outer surface can be embedded in the toner surface, and thereby, the fluidity of the toner is deteriorated.

Also, in the methods for producing a toner by suspension polymerization, since the toner particles are subjected under irregular shear during the suspension in an aqueous medium, ultrafine particles may be formed, deteriorate cleaning property and adhere to a carrier or mechanical elements.

Meanwhile, methods for producing a toner by emulsion polymerization have problems in that the thermal post-treatment for shaping is needed to produce spherical toner particles and non-congregated ultrafine particles may remain after cohesion and congregation in aqueous medium, which may cause contamination of the carrier and adhesion to mechanical elements.

In order to solve such problems, Japanese Patent Application Laid-Open (JP-A) No. 07-152202 discloses a method accompanying volume contraction, called as polymer dissolution and suspension method of polymer. In this method, a toner material is dispersed and dissolved in a volatile solvent such as low boiling point organic solvent and emulsified and dropped in an aqueous medium containing a dispersing agent, followed by removing of the volatile solvent. At this point, volume contraction occurs. However, when a solid fine particle-dispersing agent which is not dissolved in the aqueous medium is selected as a dispersing agent, indefinite shaped particles are obtained. Also, when solid contents in the solvent is high in order to productivity, the viscosity of the dispersion phase is increased, whereby the particle diameter is increased and particle distribution is broaden. In contrast, when the viscosity of the dispersion phase is reduced by reducing the molecular weight of a resin, image-fixing properties (particularly, hot offset resistance) was compromised.

Japanese Patent Application Laid-Open (JP-A) No. 11-149179 uses a resin of low molecular weight in the dissolution and suspension method to reduce the viscosity of the dispersion phase and to facilitate emulsification and makes the polymerization occur within the particles to improve the image-fixing properties. However, the improvement of the transferring property or cleaning property is not based on the regulation of the shapes of particles.

Also, since the toner particles are subjected under irregular shear during the suspension in an aqueous medium, ultrafine particles may still be formed, deteriorate cleaning property and adhere to a carrier or mechanical parts.

Further, fixing of this dry toner is performed by heating with a hot roll after developing and transferring. At this point, if the temperature of the hot roll is too high, the toner is excessively melted and adhered to the hot roll (hot offset). If the temperature of the hot roll is too low, the toner is not sufficiently melted, causing fixing failure on the roll. In the term of the energy saving and realization of a small size apparatus, there is needed a toner having a high hot offset temperature (hot offset resistance) and low fixing temperature (low temperature image-fixing properties). Also, the storage stability under heat is needed so that the toner is not blocked at a temperature in the apparatus during storage.

In full color copiers and full color printer, glossiness and color miscibility are demanded. Therefore, toners should have a low melt viscosity and a sharp melting polyester-based toner binder is used. However, since such toners tend to cause hot offset, the hot roll in the conventional full color apparatus is coated with silicone oil. In order to perform coating of the hot roll with silicone oil, an oil tank and oil coating apparatus are needed, whereby the apparatus becomes bigger and more complex. Also, the hot roll may deteriorate and maintenance is periodically needed for operation. Further, oil contaminates copy papers, films for OHP (overhead projector), and particularly, discoloration by oil may occur in OHP.

There has not been suggestions to use a solid fine particle-dispersing agent which critically affects toner formation while focusing on the volume contraction by the solid fine particle-dispersing agent.

SUMMARY OF THE INVENTION

It is an object of the present invention to provide a toner with a high transferring property for high quality image.

It is a further object of the present invention to provide a toner having a small particle diameter with low adhesion to a carrier or mechanical elements, a narrow particle distribution without containing ultrafine particles and a high durability.

It is another object of the present invention to provide a toner having a shape which can be cleaned by a simple device.

It is another object of the present invention to provide a toner having both glossiness and releasing property as a full color toner.

It is another object of the present invention to provide a method for manufacturing the toner and a method for developing and transferring a full color image using the toner.

The present inventors have conducted research and studies to develop a dry toner being excellent in powder flowidity and transferring property, when made into a small particle diameter, and storage stability under heat, low temperature image-fixing properties and hot offset resistance, particularly a dry toner being excellent in glossiness and durability, when used in a full color copier. As a result, it has been discovered that the above objects can be accomplished by the present invention.

Therefore, according to the first aspect of the present invention, there is provided a dry toner comprising fine particles having an average sphericity of 0.93 to 0.99, wherein a content of the fine particles having a particle diameter of 2 μm or less in the dry toner is 20% by number or less.

In the second aspect of the present invention, there is provided a dry toner of the first aspect, wherein the average sphericity of the fine particles is 0.95 to 0.98.

In the third aspect of the present invention, there is provided a dry toner of the first aspect, wherein the content of fine particles having a particle diameter of 2 μm or less is 10% by number or less.

In the fourth aspect of the present invention, there is provided a dry toner of the first aspect, wherein a volume average particle diameter of the fine particles is 3 μm to 10 μm, and a ratio of the volume average particle diameter to the number average particle diameter is 1.10 to 1.25.

In the fifth aspect of the present invention, there is provided a dry toner of the fourth aspect, wherein the volume average particle diameter of the fine particles is 4 μm to 7 μm, and a ratio of the volume average particle diameter to the number average particle diameter is 1.15 to 1.20.

In the sixth aspect of the present invention, there is provided a dry toner of the first aspect, wherein the dry toner comprises a colorant and a toner binder, and the dry toner contains a modified polyester and a non-modified polyester, and a weight ratio of the modified polyester and the non-modified polyester is 1/99 to 80/20.

In the seventh aspect of the present invention, there is provided a dry toner of the sixth aspect, wherein the modified polyester is modified by one of a urethane bond and a urea bond In the eighth aspect of the present invention, there is provided a dry toner of the sixth aspect, wherein the toner binder has a peak molecular weight of 1,000 to 30,000.

In the ninth aspect of the present invention, there is provided a dry toner of the sixth aspect, wherein the toner binder has an acid value of 1 mg to 30 mg KOH.

In the tenth aspect of the present invention, there is provided a dry toner of the sixth aspect, wherein the toner binder has a glass transition point (Tg) of 50° C. to 70° C.

In the eleventh aspect of the present invention, there is provided a dry toner of the first aspect, wherein the toner is obtained by volume contraction using fine solid dispersing agents in an aqueous medium at a contraction rate of 10% to 90%.

In the twelfth aspect of the present invention, there is provided a dry toner of the eleventh aspect, wherein a volume average particle diameter of the fine particles is 3 μm to 10 μm, and a ratio of the volume average particle diameter to a number average particle diameter is 1.10 to 1.25.

In the thirteenth aspect of the present invention, there is provided a dry toner of the eleventh aspect, wherein the toner is obtained by volume contraction using fine solid dispersing agents in an aqueous medium at a contraction rate of 30% to 70%.

In the fourteenth aspect of the present invention, there is provided a dry toner of the thirteenth aspect, wherein a volume average particle diameter of the fine particles is 4 μm to 7 μm, and a ratio of the volume average particle diameter to a number average particle diameter is 1.15 to 1.20.

In the fifteenth aspect of the present invention, there is provided a method for manufacturing a dry toner, comprising: a process for dispersing in an aqueous medium comprising water and a water-soluble organic solvent, a toner composition contained in an organic solvent by using fine solid dispersing agents; and a process for contracting volume of the dispersed toner composition.

In the sixteenth aspect of the present invention, there is provided a method for manufacturing a dry toner of the fifteenth aspect, further comprising a process for partially removing the fine solid dispersing agents after the process for contracting.

In the seventeenth aspect of the present invention, there is provided a method for manufacturing a dry toner of the fifteenth aspect, further comprising a process for partially removing the fine solid dispersing agents after the process for contracting.

In the eighteenth aspect of the present invention, there is provided a method for manufacturing a dry toner of the fifteenth aspect, wherein the toner composition comprises a modified polyester.

In the nineteenth aspect of the present invention, there is provided a method for manufacturing a dry toner of the fifteenth aspect, wherein the toner composition comprises a prepolymer containing an isocyanate group and amines, and the prepolymer containing an isocyanate group is reacted with the amines during the process for dispersing in the aqueous medium to form a modified polyester having one of a urethane bond and a urea bond.

In the twentieth aspect of the present invention, there is provided an image forming apparatus comprising: an electrophotographic photoconductor; a charger for charging the electrophotographic photoconductor; a light irradiator for irradiating the electrophotographic photoconductor charged by the charger so as to form a latent electrostatic image; a developer for developing the latent electrostatic image to form a developed image; and a transfer for transferring the developed image to a recording material; wherein the developer contains a dry toner which comprises fine particles having an average sphericity of 0.93 to 0.99, and the content of the fine particles having a particle diameter of 2 μm or less in the dry toner is 20% by number or less.

In the twenty-first aspect of the present invention, there is provided an image forming apparatus according to the twentieth aspect, wherein the latent electrostatic image is independently formed in multiple colors on the electrophotographic photoconductor, and the developer develops the latent electrostatic image with the developer of a corresponding color, in a plurality of developing units furnished with developing rolls and developing blades to uniformly control layer thickness of the developers supplied on the developing rolls.

In the twenty-second aspect of the present invention, there is provided an image forming apparatus according to the twentieth aspect, wherein the latent electrostatic image is independently formed in multiple colors on a plurality of the electrophotographic photoconductors, and the developer develops the latent electrostatic image with the developer of a corresponding color, in a plurality of developing units furnished with developing rolls and developing blades to uniformly control layer thickness of the developers supplied on the developing rolls.

In the twenty-third aspect of the present invention, there is provided a process for forming an image comprising: a step for charging an electrophotographic photoconductor; a step for irradiating light on to the electrophotographic photoconductor so as to form a latent electrostatic image; a step for developing the latent electrostatic image with a developer to form a developed image; and a step for transferring the developed image to a recording medium, wherein the developer contains a dry toner which comprises fine particles having an average sphericity of 0.93 to 0.99, and the content of the fine particles having a particle diameter of 2 μm or less in the dry toner is 20% by number or less.

In the twenty-fourth aspect of the present invention, there is provided a process for forming an image according to the twenty-third aspect, wherein the latent electrostatic image is independently formed in multiple colors on the electrophotographic photoconductor, and the developer develops the latent electrostatic image with the developer of a corresponding color, in a plurality of developing units furnished with developing rolls and developing blades to uniformly control layer thickness of the developers supplied on the developing rolls, and the step for transferring is carried out after the developed image is being transferred onto an intermediate transfer body by an electric field.

In the twenty-fifth aspect of the present invention, there is provided a process for forming an image according to the twenty-third aspect, wherein the latent electrostatic image is independently formed in multiple colors on a plurality of the electrophotographic photoconductors, and the developer develops the latent electrostatic image with the developer of a corresponding color, in a plurality of developing units furnished with developing rolls and developing blades to uniformly control layer thickness of the developers supplied on the developing rolls, and the step for transferring is carried out after the developed image is being transferred onto an intermediate transfer body by an electric field.

DESCRIPTION OF THE PREFERRED EMBODIMENTS

Now, the present invention will be described in detail.

Generally, the particle size (diameter) of a toner is smaller, it is advantageous to obtain an image with a high resolution and high quality. However, it is disadvantageous in terms of the transferring property and cleaning property. The present inventors have discovered that it is possible to obtain an image with high quality, good transferring property and cleaning property by using a toner having a certain sphericity and a low content of fine particles with a diameter of 2 μm or less.

Also, we have discovered that high durability can be realized by using a toner having a certain sphericity and a low content of fine particles with a diameter of 2 μm or less. In two-component developers, the toner does not adhere to the surface of a carrier during a long-term stirring in a developing apparatus nor deteriorate the charging ability. In one-component developers, the toner does not form a film on a developing roller nor is fused on a member such as a blade for thinning of the toner.

By using a dry toner having a volume average particle diameter of 3 μm to 10 μm, and the ratio of the volume average particle diameter to the number average particle diameter is 1.10 to 1.25 and a sphericity of 0.93 to 0.99, which is prepared by volume contraction with a contraction rate of 10 to 90% in an aqueous medium using a solid fine particulate dispersing agent, it is possible to attain excellent storage stability under heat, low temperature image-fixing properties and hot offset resistance, and glossiness, when used in a full color copier. Also, in the two-component developers, the dry toner shows stable developing properties without any change in the particle diameter after long-term stirring in a developing apparatus. In the one-component developers, the dry toner shows stable developing properties and produces stable images without any change in the particle diameter after long-term stirring in a developing apparatus, formation of a film on a developing roller and fusion on a member such as a blade for thinning the toner layer.

Meanwhile, when the particle diameter of the toner exceeds the range of the present invention, it is impossible to obtain an image having high resolution and the change of the particle diameter after a long-term use in a developing apparatus (stirring) is increased. Also, when the ratio of the volume average particle diameter to the number average particle diameter exceeds 1.25, it is also the case.

When the ratio of the volume average particle diameter to the number average particle diameter is less than 1.10, the toner cannot be sufficiently charged or can deteriorate cleaning property though it is preferable in terms of the behavior stability of and uniformity of the charge quality.

In the present invention, method of manufacturing a toner is not particularly limited, however, in order to obtain a toner having features of the present invention easily and surely, it is preferable to use a manufacturing method comprising a process for volume contraction which attains volume contraction rate of 10 to 90% after being dispersed in an aqueous medium added with a solid fine particulate dispersing agent.

Here, the contraction rate is expressed by the following formula:

$$\text{Contraction rate}=(1-Vt/Vo)\times 100$$

in which Vo is a volume of the oil phase (dispersion phase) where a toner composition is dispersed in an aqueous medium before emulsification dispersion and Vt is a volume of the dispersion phase after emulsification dispersion and removal of volatile components, and show change in characteristics between before emulsification and after formation of particles.

Specifically, the contraction rate is measured by the following methods:

(1) measuring weights and specific gravities of the oil phase before emulsification and the manufactured toner, and (2) measuring average particle diameters of droplets after emulsification in an aqueous medium and particles after removal of volatile components and converting them into volumes.

(Control of Toner Formation and Content of Fine Particles)

Generally, solid fine particles adhere to the surface of an oil droplet to stabilize the droplet as a sphere. As volatile components are removed, the volume of the droplet is reduced while the solid fine particles remains on the surface. Since the surface area of the droplet is slowly reduced but the reduction of the volume does not keep up with this, the droplet cannot maintain the spherical shape and becomes indefinite.

However, upon removal of the volatile components, if the adsorption of the solid fine particles on the interface is weakened, the solid fine particles can be detached from the droplet and the reduction of the surface area of the droplet can be alleviated. As a result, the droplet can form a particle with unevenness on the surface as the volume is reduced.

For example, it is possible to weaken the adsorption of the solid fine particle on the interface by adding a surfactant or polymer protective colloid to cause exchange adsorption or control pH in the aqueous medium, thereby changing charge of the solid fine particle and the interface.

Also, it is possible to control the formation of the toner by partially dissolving and removing the solid fine particle adhered to the surface during the removing of the volatile components.

In order to reduce the content of the fine particles with a diameter of 2 μm or less, the viscosity of the oil droplet during emulsification dispersion is advantageously high, since micro parts seldom break but congregate under shear. However, if the viscosity of the oil phase is high from the beginning, droplets of a small particle diameter cannot be dispersed. According to the present invention, a toner composition is dissolved or dispersed with a solid fine particulate dispersing agent and dispersed in an aqueous medium containing a water-miscible organic solvent, whereby the organic solvent used in the oil phase is diffused in the aqueous medium. As a result, the oil phase becomes a viscosity at which the oil droplet seldom breaks but readily congregates, thereby reducing the content of the fine particles. A method for manufacturing will be describer later.

(Measurement of Particle Distribution)

The average particle diameter and the particle-size distribution of the toner is measured using a Coulter multisizer III (made by Coulter Electronics Inc.) apparatus and analyzed by a personal computer (International Business Machines Corporation) with an exclusive solution software. The Kd value is set with standard particles of 10 μm and the aperture current is automatically set. An aqueous solution of about 1% of NaCl is prepared as the electrolytic solution, using a first-grade sodium chloride. For example, ISOTON (trade name)-II (made by Coulter Scientific Japan Co.) may be used. 0.1-5 ml of a surface-active agent (preferably alkyl benzene sulfonate salt) is added as a dispersing agent in 100-150 ml of the above-described electrolytic solution, and 2-20 mg of the sample to be measured is added. The electrolytic solution in which the sample is suspended is dispersed for about 1-3 minutes using an ultrasonic dispersion apparatus. The volume distribution and the number distribution of the toner is calculated by measuring the volume of and the number (50,000 count) of toner particles having a particle diameter of 2 μm or more for each channel by the above-described measuring apparatus using an aperture having a diameter of 100 μm. The volume-average particle diameter and the number-average particle diameter of toner particles are obtained from the volume distribution and the number distribution, respectively, of the toner particles in the present invention.

(Measurement of Sphericity)

It is important that the toner of the present invention has a particular shape, as well as distribution in various shapes.

When the toner has a sphericity of less than 0.93 and an indefinite shape far from a spherical shape, satisfactory transferring ability and high quality images cannot be obtained. The shape of the toner can be suitably measured by an optical detection method comprising passing a suspension containing toner particles through a detection site of an imaging unit on a flat plate, and optically detecting and analyzing the image of toner particles using a CCD camera. It was found that the toner having a sphericity—which is a value obtained by dividing a circumferential length of a corresponding circle having an equal projection area obtained by the above method by the circumferential length of a real particle-of 0.93 or more, is effective in forming a very fine image having proper density. Preferably, the average sphericity is 0.93 to 0.99. More preferably, the average sphericity is 0.95 to 0.98. Also, the content of particles having a particle diameter of 2 μm is 20% by number or less, preferably 10% or less. This value can be measured as an average sphericity and the content of particles having a particle diameter of 2 μm or less by using a flow-type particle image analyzer FPIA-2000 (manufactured by Toa Iyo Denshi Co.). As a concrete measuring method, a surfactant and, preferably, an alkylbenzene sulfonate is added as a dispersing agent in an amount of 0.1 to 0.5 ml to 100 to 150 ml of water in a container from which solid impurities have been removed in advance and, then, a sample to be measured is added in an amount of from about 0.1 to 0.5 g. The suspension in which the sample is dispersed is dispersed by an ultrasonic dispersing machine for about 1 to 3 minutes such that the dispersing agent has a concentration of 3,000 to 10,000 particles/μl, and the toner shape is measured by using the above-mentioned device.

(Measurement of Molecular Weight)

The molecular weight distribution of the toner binder component according to the present invention is measured by the following method. 1 g of the toner is placed in an Erlenmeyer flask and 10 to 20 g of tetrahydrofuran (THF) is added to form a THF solution with a binder concentration of 5 to 10%. A column was stabilized in a heat chamber of 40° C., tetrahydrofuran (THF) is allowed to flow through the column at the temperature at a flow rate of 1 ml per minute, and 20 μl of the THF solvent is injected. When the molecular weight of the sample is measured, the molecular weight distribution of the sample is calculated from the relationship between the logarithmic value of calibration curve prepared by various types of monodispersed polystyrene standard samples and the retention time. As the standard polystyrene sample for preparing the calibration curve, for example, the sample having a molecular weight of $2.7\times10^2$ to $6.2\times10^6$ manufactured by Tosoh Corporation can be used. As a detector, R1 (refractive index) detector is used. As the column, a combination of TSK gel, G1000H, G2000H, G2500H, G3000H, G4000, G5000H, G6000H, G7000H, GMH and the like may be used.

The main peak molecular weight is usually 1,000 to 30,000, preferably 1,500 to 10,000, and more preferably 2,000 to 8,000. When the molecular weight is less than 1,000, the storage stability under heat is deteriorated and when it exceeds 30,000, the low temperature image-fixing property is deteriorated. The content of a component having a molecular weight of 30,000 or more is 1 to 10%, preferably 3 to 6%. The content of less than 1% cannot provide sufficient hot offset resistance while the content of more than 10% causes deterioration in the glossiness and transparency. The value of Mw/Mn is preferably up to 5. When it exceeds 5, the sharpness is reduced and glossiness is deteriorated.

(Measurement of Glass Transition Point)

In the DSC measurement, the heat exchange of the toner is measured to determine its behavior and in view of the principle of measurement, the measurement may thus preferably be carried out using a differential scanning calorimeter of a highly precise, inner-heat input compensation type. For example, it is possible to use DSC-200, manufactured by Seiko instruments Inc.

The measurement is carried out according to ASTM D3418-82. To make the measurement, temperature is once raised and then dropped to take a previous history and thereafter the temperature is raised in the range of 0 to 200° C. at a temperature rate of 10° C./min to form a DSC curve. Specifically, the measurement is carried out by the following procedure:

1. 10±1 mg of a pulverized sample is placed on an aluminum test sample container, which is then crimped with aluminum lid.

2. The glass transition point (Tg) is measured by the DSC method in an atmosphere of nitrogen.

Here, the sample is heated from room temperature to 200° C. with a temperature increasing rate of 10° C./min and is then allowed to stand at 150° C. for 10 minutes. Then, it is cooled to 0° C. at a temperature decreasing rate of 50° C./min and is allowed to stand for 10 minutes. In a stream of nitrogen (20 cc/min), the sample is again heated to 200° C. with a temperature increasing rate of 10° C./min and subjected to the DSC measurement. The glass transition point (Tg) refers a point at which the curve clearly gets off from the base line, that is, when the differential value of the peak curve is plus, the increment of the value is increased or the value turns from a minus value to a plus value.

The dry toner of the present invention contains a toner binder and a colorant. The toner binder may utilize publicly known materials suitably selected, and for instance, modified polyester or a combination of modified polyester and non-modified polyester may preferably be used.

(Modified Polyester)

Modified polyester refers to conditions where in addition to acid, a functional group contained in a monomer of alcohol and chemical bonds other than an ester bond exist in a polyester resin or a resin component having a different composition is attached by a covalent bond or ionic bond in a polyester resin.

For example, terminals of polyester are reacted with one other than an ester bond. Specifically, a functional group such as an isocyanate group which reacts with an acid group and hydroxyl group is introduced to terminals of polyester, which is then reacted with active hydrogen compound to modify or expand the terminal.

In the case of compounds having a plurality of active hydrogen, the examples of modified polyester also include compounds with polyester terminals bound to each other (Urea-modified polyester and urethane-modified polyester).

Also, compounds in which an active group such as a double bond is introduced in a main chain of polyester, which is than subjected to radical polymerization to introduce graft component of a carbon-carbon bond into a side chain or double bonds are cross-linked (styrene-modified and acryl-modified polyester).

Further, a different resin component is copolymerized or reacted to a carboxyl group or hydroxyl group at the terminal in a main chain of polyester. For example, compounds copolymerized with silicone resin modified with carboxyl group, hydroxyl group, epoxy group, mercapt group at terminals thereof.

Now, the specific explanation will be given hereinafter.

(Urea-Modified Polyester)

Given as examples of the polyester modified by a urea bond (i) are reaction products of a polyester polymer (A) having an isocyanate group and amines (B). Given as examples of the polyester prepolymer (A) having an isocyanate group are products synthesized by further reacting a polyester, which is a polycondension product of the polyol (1) and the polycarboxylic acid (2) and has an active hydrogen-containing group, with the polyisocyanate (3). As the active hydrogen-containing group, hydroxyl groups (alcoholic hydroxyl groups and phenolic hydroxyl groups) and carboxyl groups are exemplified. Among these compounds, alcoholic hydroxyl groups are preferable.

Given as examples of the polyol (1) are diols (1-1) and polyols (1-2) having three or more valences. It is preferable to use the compound (1-1) alone or a mixture of the compound (1-1) and a small amount of the compound (1-2). Examples of the diols (1-1) include alkylene glycols (e.g., ethylene glycol, 1,2-propylene glycol, 1,3-propylene glycol, 1,4-butane diol and 1,6-hexane diol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexane dimethanol and hydrogenated bisphenol A); bisphenols (e.g., bisphenol A, bisphenol F and bisphenol S); alkylene oxides (e.g., ethylene oxide, propylene oxide and butylene oxide) adducts of the above alicyclic diols; alkylene oxides (e.g., ethylene oxide, propylene oxide and butylene oxide) adducts of the above bisphenols, and the like. Among these compounds, C2-C12 alkaline glycols and alkaline oxide adducts of bisphenols are preferable. Also, alkaline oxide adducts of bisphenols, and combinations of the alkaline oxide adducts of bisphenols and C2-C12 alkaline glycols are particularly preferable. Examples of the polyols (1-2) with three or more valences include polyvalent aliphatic alcohols having 3-8 or more valences (e.g., glycerol, trimethylolethane, trimethylol propane, pentaerythritol and sorbitol); phenols having 3 or more valences (e.g., trisphenol PA, phenol novolak and cresol novolak); alkaline oxide adducts of the above polyphenols having three or more valences, and the like.

Given as preferable examples of the polycarboxylic acid (2) are dicarboxylic acids (2-1) and polycarboxylic acids having three or more valences (2-2). It is preferable to use the dicarboxylic acid 2-1) singly or mixtures of the dicarboxylic acid (2-1) and a small amount of the polycarboxylic acid (2-2). Examples of the dicarboxylic acid (2-1) include alkylenedicarboxylic acids (e.g., succinic acid, adipic acid, sebacic acid); alkenylenedicarboxylic acid (e.g., maleic acid and fumaric acid); aromatic dicarboxylic acids (e.g., phthalic acid, isophthalic acid, terephthalic acid and naphthalenedicarboxylic acid), and the like. Among these compounds, C4-C20 alkenylenedicarboxylic acids and C8-C20 aromatic dicarboxylic acids are preferable. Given as examples of the polycarboxylic acid (2-2) having 3 or more valences are C9-C20 aromatic polycarboxylic acid (e.g., trimellitic acid and pyromellitic acid), and the like. As the polycarboxylic acid (2), acid anhydrides or lower alkylesters (e.g., methylesters, ethylesters and isopropylesters) of the above mentioned compounds may be reacted with the polyol (1).

The ratio of the polyol (1) to the polycarboxylic acid (2) is generally 2/1 to 1/1, preferably 1.5/1 to 1/1 and more preferably 1.3/1 to 1.02/1 in terms of equivalent ratio of a hydroxyl group [OH] to a carboxyl group [COOH], namely [OH]/[COOH].

Given as examples of the polyisocyanate (3) are aliphatic polyisocyanates (e.g., tetramethylene diisocyanate, hexamethylene diisocyanate and 2,6-diisocyanatomethyl caproate); alicyclic polyisocyanates (e.g., isophorone diisocyanate and cyclohexylmethane diisocyanate); aromatic diisocyanates (e.g., α, α, α', α'-tetramethylxylylene diisocyanate); isocyanates; products obtained by blocking these polyisocyanates with phenol derivatives, oximes, caprolactams; mixtures of two or more of these compounds, and the like.

The ratio of the polyisocyanate (3) is generally 5/1 to 1/1, preferably 4/1 to 1.2/1 and more preferably 2.5/1 to 1.5/1 in terms of equivalent ratio of an isocyanate group [NCO] to a hydroxyl group [OH] of the polyester having a hydroxyl group, namely [NCO]/[OH]. When the ratio [NCO]/[OH] exceeds 5, the low temperature image-fixing properties is deteriorated. When the ratio [NCO]/[OH] is less than 1, the urea content in the modified polyester is lowered and the hot offset resistance is deteriorated. The content of the polyisocyanate (3) in the prepolymer (A) containing an isocyanate group at its terminal is generally 0.5% by weight to 40% by weight, preferably 1% by weight to 30% by weight and more preferably 2% by weight to 20% by weight. When the content is less than 0.5% by weight, the hot offset resistance is deteriorated and this is disadvantageous in view of the compatibility of the storage stability under heat with the low temperature image-fixing properties. When the content is above 40% by weight, the low temperature image-fixing properties is deteriorated.

The number of isocyanate groups contained in one molecule of the polyester prepolymer (A) having an isocyanate group is generally 1 or more, preferably 1.5 to 3 in average and more preferably 1.8 to 2.5 in average. When the number of isocyanate groups contained in one molecule is less than 1, the molecular weight of the urea-modified polyester is decreased and the hot offset resistance is deteriorated.

Given as examples of the amines (B) are diamines (B1), polyamines with 3 or more valences (B2), amino-alcohols (B3), amino-mercaptans (B4), amino acids (B5), the compounds (B6) produced by blocking the amino groups of the amines (B1)-(B5). Examples of the diamine (B1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminocyclohexane and isophoronediamine); aliphatic diamines (e.g., ethylene diamine, tetramethylenediamine and hexamethylenediamine), and the like. Given as examples of the polyamine (B2) having 3 or more valences include diethylenetriamine, triethylenetetramine, and the like. Given as examples of the aminoalcohols (B3) include ethanolamine, hydroxyethylaniline, and the like. Given as examples of the aminomercaptan (B4) include aminoethylmercaptan, aminopropylmercaptan, and the like. Given as examples of the amino acid (B5) include aminopropionic acid, aminocaproic acid, and the like. Given as examples of the compounds (B6) produced by blocking the amino groups of the amines (B1)-(B5) are ketimine compounds, oxazoline compounds obtained from the amines (B1)-(B5) and ketones (e.g., acetone, methyl ethyl ketone, methyl isobutyl ketone), and the like. Preferable examples among these amines (B) are the amines (B1) and mixtures of the amines (B1) and a small amount of the amines (B2).

Moreover, the molecular weight of the urea-modified polyester may be controlled as required using a reaction stopper. As the reaction stopper, monoamines (e.g., diethylamine, dibutylamine, butylamine and laurylamine) and the products (e.g., ketimine compounds) obtained by blocking these compounds may be exemplified.

The ratio of the amines (B) is generally 1/2 to 2/1, preferably 1.5/1 to 1/1.5 and more preferably 1.2/1 to 1/1.2 in terms of equivalent ratio of an isocyanate group [NCO] contained in the prepolymer (A) having an isocyanate group to an amino group [NHx] contained in the amines (B), namely [NCO]/[NHx]. When the equivalent ratio exceeds 2 or less than 1/2, the molecular weight of the urea-modified polyester (i) is decreased and the hot offset resistance is deteriorated. In the present invention, a urethane bond may be included together with a urea bond in the urea-modified polyester (i). The mole ratio of the urea bond to the urethane bond is generally 100/0 to 10/90, preferably 80/20 to 20/80 and more preferably 60/40 to 30/70. When the mole ratio of the urea bond to the urethane bond is less than 10%, the hot offset resistance is deteriorated.

The urea modified polyesters (i) of the present invention may be produced by a one shot method or a prepolymer process. The weight-average molecular weight of the urea-modified polyester (i) is generally 10,000 or more, preferably 20,000 to 10,000,000 and more preferably 30,000 to 1,000,000. When the weight-average molecular weight less than 10,000, the hot offset resistance is deteriorated. No particular limitation is imposed on the number average molecular weight of the urea-modified polyester, particularly when the non-modified-polyester (ii) described later is used and the number average molecular weight may be one that can attain the above weight-average molecular weight. When the modified polyester (i) is singly used, the average molecular weight is generally 20,000 or less, preferably 1,000 to 10,000 and more preferably 2,000 to 8,000. When the number average molecular weight exceeds 20,000, the low temperature image-fixing properties and the glossiness, when the modified polyester is used in a full color system, are deteriorated.

(Non-Modified Polyester)

In the present invention, not only the single use of the polyester (i) modified by a urea bond is allowed but also the non-modified-polyester (ii) in addition to the polyester (i) may be preferably contained as a toner binder component. The combined use of the polyester (ii) is more desirable than the single use of the polyester (i) because the low temperature image-fixing properties and the glossiness when the polyester is used in a full color system are improved. Given as examples of the polyester (ii) are the same condensation-polymerized products of the polyol (1) and the polycarboxylic acid (2) as the aforementioned examples used for the polyester component (i). Preferable examples are the same as those used for the polyester (i). Also, the polyester (ii) is not limited to the non-modified-polyesters but may be those modified by chemical bonds other than a urea bond and for instance, those modified by a urethane bond are preferably used. It is preferable that at least each part of the polyesters (i) and (ii) be mutually solved in view of the low temperature image-fixing properties and hot offset resistance. Accordingly, it is desirable that the polyester components (i) and (ii) have similar compositions. When the polyester (ii) is contained, the weight ratio of the polyester (i) to the polyester (ii) is generally 5/95 to 80/20, preferably 5/95 to 30/70, more preferably 5/95 to 25/75 and particularly preferably 7/93 to 20/80. When the weight ratio of the polyester (i) is less than 5%, the hot offset resistance is deteriorated and this is disadvantageous in view of the compatibility of the storage stability under heat with the low temperature image-fixing properties.

It is desirable that the polyester (ii) have a peak molecular weight in a range between, generally 1,000 and 30,000, preferably 1,500 and 10,000 and more preferably 2,000 and 8,000. When the peak molecular weight is less than 1,000, the storage stability under heat is deteriorated and when it exceeds 10,000, the low temperature image-fixing properties are deteriorated. The hydroxyl valence of the polyester (ii) is preferably 5 or more, more preferably 10 to 120 and particularly preferably 20 to 80. When the hydroxyl valence is less than 5, this is disadvantageous in view of the compatibility of the storage stability under heat with the low temperature image-fixing properties. The acid valence of the polyester (ii) is generally 1 to 30, preferably 5 to 20. By the provision of a certain acid value, the polyester tends to be negatively charged.

In the present invention, the glass transition temperature (Tg) of the toner binder is generally 50° C. to 70° C. and preferably 55 to 65° C. When Tg is lower than 50° C., the storage stability of the toner under heat is deteriorated. When Tg exceeds than 70° C., the low temperature image-fixing properties are not sufficiently performed. The toner of the present invention tends to exhibit excellent storage stability due to the inclusion of the urea-modified polyester resin in contrast to known polyester type toners even if the glass transition temperature is low. As to the elastic modulus of the toner binder during storage, the temperature (TG') when the elastic modulus reaches 10,000 dyne/$cm^2$ at a measuring frequency of 20 Hz is generally 100° C. or more and preferably 110 to 200° C. When the temperature is lower than 100° C., the hot offset resistance becomes deteriorated. With regard to the viscosity of the toner binder, the temperature (Tη) when the viscosity reaches 1,000 poises at a measuring frequency of 20 Hz is generally 180° C. or less and preferably 90° C. to 160° C. When the temperature exceeds 180° C., the low temperature image-fixing properties is deteriorated. That is, it is preferable that the temperature TG' is higher than the temperature Tη in view of the compatibility of the low temperature image-fixing properties with the hot offset resistance. In other words, the difference between the temperature TG' and the temperature Tη, namely (TG'−Tη) is preferably 20° C. or more, more preferably 10° C. or more and particularly preferably 20° C. or more. There is no limitation to the upper limit of the difference. Further, it is desirable that the difference between the temperature Tη and the temperature Tg, namely (Tη−Tg) is preferably 0° C. to 100° C., more preferably 10° C. to 90° C. and particularly preferably 20° C. to 80° C. in view of the compatibility of the storage stability under heat with the low temperature image-fixing properties.

(Colorant)

As the colorant for use in the toner of the present invention, any conventionally known dyes and pigments can be employed. Examples of the dyes and pigments are carbon black, nigrosine dyes, black iron oxide, Naphthol Yellow S, HANSA Yellow (10G, 5G, G), cadmium yellow, yellow iron oxide, yellow ochre, chrome yellow, Titan Yellow, Polyazo Yellow, Oil Yellow, HANSA Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, Bengala, red lead oxide, red lead, cadmium red, cadmium mercury red, antimony red, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, LITHOL Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chrome oxide, Persian, emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. The amount of the colorant may be typically in the range of 1% by weight to 15% by weight, preferably in the range of 3% by weight to 10% by weight based on the weight of the toner.

The colorant used in the present invention can be a master batch combined with resins. As binder resins that can be added to the master batch, the following resins can be employed in addition to the modified or non-modified polyester resins: homopolymers of styrene and substituents thereof such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyester; epoxy resin; epoxypolyol resin, polyurethane; polyamide, polyvinyl butyral; polyacrylic resin; rosin; modified rosin; terpene resin, aromatic or alicyclic hydrocarbon resin, aromatic petroleum resin, chlorinated paraffin, and paraffin wax, wherein the foregoing can be used alone or in combination.

The master batch of the present invention can be obtained by mixing and kneading a resin for the master batch and a colorant under high shear. In order to raise the interaction between the colorant and the resin, an organic solvent may be used. Also, according to the so-called flushing method, aqueous paste containing a colorant and water is mixed and kneaded with the resin and the organic solvent, the colorant is transferred to the resin and the water and the organic solvent are removed. This method is preferred since the wet cake of the colorant can be used as it is without drying. For the mixing and kneading process, high shear dispersing apparatus with a three-roll mill is preferably used.

(Releasing Agent)

The toner of the present invention may include a wax as a releasing agent in combination of the toner binder and the colorant. Given as examples of the wax which can be used in the present invention are conventionally well-known waxes, such as polyolefin waxes (e.g., polyethylene wax and polypropylene wax); long chain hydrocarbons (e.g., paraffin wax and sazole wax); carbonyl group-containing waxes, and the like. Among these waxes, carbonyl group-containing waxes are preferable. Examples of the carbonyl group-containing wax include polyalkanates (e.g., carnauba wax, montan wax, trimethylolpropane tribehenate, pentaerythritol tetrabehenate, pentaerythritol diacetate dibehenate, glycerol behenate and 1,18-octadecanediol distearate); polyalkanol esters (e.g., tristearyl trimellitate and distearyl maleate); polyalkanic acid amides (e.g., ethylenediaminedibehenylamide); polyalkylamides (e.g., tristearylamide trimellitate); dialkyl ketones (e.g., distearyl ketone), and the like. Among these carbonyl group-containing waxes, polyalkanates are preferable. The melting point of the wax used in the present invention is generally 40 to 160° C., preferably 50 to 120° C. and more preferably 60 to 90° C. Waxes having a melting point less than 40° C. adversely affect the storage stability under heat whereas waxes having a melting point exceeding 160° C. tends to cause a cold offset during a fixing step performed at low temperatures. The melt viscosity of the wax used in the present invention is preferably 5 cps to 1,000 cps and more preferably 10 cps to 100 cps as the value measured at a temperature 20° C. higher than the melting point. Waxes having a viscosity exceeding 1,000 cps produce only a poor effect on the hot offset resistance and the low temperature image-fixing properties. The content of the wax in the toner is generally 0 to 40% by weight, preferably 3% by weight to 30% by weight.

(Charge Controlling Agent)

The toner according to the present invention may further comprise a charge controlling agent, as required. Any conventional charge controlling agents can be used in the present invention. For instance, there can be employed a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus, a phosphorus-containing compound, tungsten, a tungsten-containing compound, a fluorine-containing active material, a metallic salt of salicylic acid and a metallic salt of a salicylic acid derivative. Specifical examples of charge controlling agents for use in the toner of the present invention include BONTRON 03 (Nigrosine dyes), BONTRON P-51 (Quaternary ammonium salts), BONTRON S-34 (metal-containing azo dyes), E-82 (oxynaphthoic acid type metal complex), E-84 (salicylic acid type metal complex) and E-89 (phenol type condensation products), which are manufactured by Orient Chemical Industries Co., Ltd., TP-302 and TP-415 (quaternary ammonium salts molybdenum complex), which are manufactured by Hodogaya Chemical Co., Ltd., Copy Charge PSY VP2038 (quaternary ammonium salts), Copy Blue PR (triphenylmethane derivatives), Copy Charge NEG VP2036 (quaternary ammonium salts) and Copy Charge NX VP434(quaternary ammonium salts), which are manufactured by Hoechst AG, LRA-901 and LR-147 (boron complex), which are manufactured by Japan Carlit Co., copper Phthalocyanine, perylene; quinacridone, azo type pigments, and polymer compounds having a functional group such as a sulfonic acid group, a carboxyl group or a quaternary ammonium salt group.

The amount of the used charge controlling agent is determined depending on the type of the binder resin, the presence of additive used as needed, the dispersion method, and is preferably in the range of 0.10 weight parts to 10 weight parts per 100 weight parts of the binder resin, though it is not limited thereto. More preferably, it is 0.2 weight parts to 5 weight parts per 100 weight parts of the binder resin. When it exceeds 10 weight parts, chargeability becomes too great, the electrostatic absorption force with the developing roll is increased due to reduction of effect of the main charge controlling agent, and fluidity of the developing agent and image density are reduced. These charge controlling agent and releasing agent can be melt-blended with a master batch and resin or can be added upon dissolution and dispersion to an organic solvent.

The preparation of dry toner according to the present invention will be described hereinafter. Although the preparation of dry toner according to the present invention is particularly good in that the dry toner of the present invention can be prepared simply and reliably, it should be not construed to exclude dry toners prepared by other preparations methods from the dry toner of the present invention. In the case of dry toners, as far as the dry toners have the characteristics of the present invention, the dry toner is included in the scope of the present invention regardless of the preparation thereof.

(Preparation of Toner in Aqueous Medium)

As the aqueous medium used in the dry toners of the invention, water may be used alone, but it is more preferable to use in combination with a solvent miscible with water, since the organic solvent used in the oil phase is smoothly diffused in the aqueous medium, and the viscosity of the oil droplet becomes a viscosity at which it seldom breaks but readily congregates, thereby reducing the content of the fine particles. Given as examples of the miscible solvent are alcohols (e.g., methanol, isopropanol and ethylene glycol), dimethylformamide, tetrahydrofuran, cellosolves (e.g., methyl cellosolve) and lower ketones (e.g., acetone and methyl ethyl ketone). The mixing ratio is preferably 0.1 to 100 weight parts of the solvent, more preferably 1 to 10 weight parts per 100 weight parts of water.

It is preferable that the toner binder is prepared by the following methods. The polyester (A) having a hydroxyl group is obtained by dehydrating and condensing the polycarboxylic acid (2) and the polyol (1) under heat at 150° C. to 280° C. in the presence of a known esterifying catalyst, e.g., tetrabutoxy titanate or dibutyltin oxide, if needed under reduced pressure while collecting water. Subsequently, the prepolymer (A) containing an isocyanate is obtained by reacting the polyisocyanate (3) with the polyester (A) and the polyol (B) at 40° C. to 140° C. The polyester (i) modified by a urea bond is obtained by further reacting (A) with the amines (B) at 0° C. to 140° C. In the reaction of (3) and (A) and (B), a solvent may be used if necessary. Given as examples of the solvent which can be used are those inactive to the isocyanate (3), such as aromatic solvents (e.g., toluene, xylene, and the like); ketones (e.g., acetone, methyl ethyl ketone, methyl isobutyl ketone, and the like); esters (e.g., ethyl acetate, and the like); amides (e.g., dimethylformamide, dimethylacetamide, and the like) and ethers (e.g., tetrahydrofuran, and the like). When the non-modified-polyester (ii) is used in combination, it is obtained in the same manner as in the case of the polyester (A) having a hydroxyl group and mixed with in the solution of the polyester (i).

In order to perform the volume contraction of the toner composition and to lower the viscosity of the oil phase, a volatile solvent in which the modified polyester (i) and (A) can be dissolved. As the solvent, solvents having a boiling point less than 100° C. is preferred. Examples of useful solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, methylisobutylketone and the like. These are used alone or in combinations of two or more. Particularly desirable are aromatic solvents such as toluene, xylene and the like, and halogenated hydrocarbons such as methylene chloride, 1,2-dichloroethane, chloroform, carbon tetrachloride and the like. By applying soluble solvents in any aqueous medium such as alcohol, water or the like, it may further control the volume contraction. The amount of the used solvent is usually 10 parts to 900 parts per 100 parts of the toner composition.

The toner particles can be formed by reacting the dispersion of the prepolymer (A) containing an isocyanate group and other toner compositions in a volatile organic solvent with amines (B) in an aqueous medium or previously prepared modified polyester (i) can be used. The method for stably forming the dispersion of modified polyester (i) or prepolymer (A) and the toner composition in the aqueous medium includes a method of adding the composition of the toner materials comprising urea-modified polyester (i) or prepolymer (A) to the aqueous medium and dispersing the contents by shearing. The prepolymer (A) and other toner components such as a colorant, colorant master batch, releasing agent, charge controlling agent, non-modified polyester resin (hereinafter, toner materials) can be mixed during forming the dispersion in the aqueous medium. However, preferably, the toner materials are previously mixed and the mixture is added and dispersed in the aqueous medium. For the dispersion process, generally mixers by stirring, more preferably homogenizer having high speed rotator and stator, high pressure homogenizer and dispersers such as those having media, for example, a ball, beads mill, sand mill can be used. Also, in the present invention, other toner materials such as a colorant, releasing agent, charge controlling agent can be mixed when particles are formed in the aqueous medium but also can be added after formation of the particles. For example, after forming particles without containing a colorant, the colorant can be added by the well-known dye absorption method.

No particular limitation is imposed on the dispersion method and known machines such as a low speed shearing type, high speed shearing type, friction type, high pressure jet type and ultrasonic type may be applied. It is desirable to use a high speed shearing type to obtain a dispersion having a particle diameter of 2 μm to 20 μm.

The emulsifier having rotatable blades is not particularly limited, but includes conventional emulsifying apparatuses or dispersing equipment commercially available in market. For instance, there can be exemplified batch type or continuous type emulsifier alone or in combination with both of them such as ULTRA TURRAX (manufactured by IKA Werke.), POLYTRON (manufactured by Kinematika Co., Ltd.), TK Auto Homomixer (manufactured by Tokushu Kika Kogyo Co,. Ltd.), and the like; a continuous type emulsifier such as Ebara Milder (manufactured by Ebara Corporation), TK Pipeline Homomixer and TK Homomik Line Flow (manufactured by Tokushu Kika Kogyo Co,.Ltd.), Colloid Mill (manufactured by Shinko Pantek Co., Ltd.), Slusher and Trigonal Wet Grinder (manufactured by Mitsui Miike Kakoki Co., Ltd.), Cavitron (manufactured by Eurotek Inc.), Fine Flow Mill (manufactured by Taiheiyo Kiko Co., Ltd.), and the like; and a batch and continuous emulsifier such as Cleamix (manufactured by M Technique Co., Ltd.), Fillmix (manufactured by Tokushu Kika Kogyo Co.,Ltd.), and the like.

When the high speed shearing type dispersing machine is used, the number of rotation is, though not limited to, generally 1000 rpm to 30000 rpm and preferably 5000 rpm to 20000 rpm and the dispersion time is, though not limited to, generally 0.1° C. to 5 minutes in a batch system. The dispersion temperature is generally 0° C. to 150° C. (under pressure) and preferably 40° C. to 98° C. High dispersion temperature is desirable because the viscosity of the resulting dispersion consisting of the prepolymer (A) is decreased and the dispersion is easily attained.

The amount of the aqueous medium to be used for 100 parts by weight of the prepolymer (A) is generally 50 parts by weight to 2000 parts by weight and preferably 100 parts by weight to 1000 parts by weight. An amount less than 50 parts by weight leads to an impaired dispersion condition of the prepolymer (A) and hence toner particles with a desired particle diameter are not obtained whereas an amount exceeding 20000 parts by weight is uneconomical.

Although the fine solid particles can be dispersed in an aqueous medium, it is possible to use in combination with other dispersing agents to adsorption of a solid dispersing agent to the droplet as described below. Additional dispersing agents can be added before emulsification of the toner composition or during removing of the volatile components after emulsification.

(Fine Solid Dispersing Agent)

It is preferred that the dispersion of the fine solid particles which exist in the solid form which is not water soluble in aqueous medium and the particle diameter be in the range of 0.01 μm to 1 μm.

Examples of the inorganic fine particles are silica, alumina, titanium oxide, barium titanate, magnesium titanate, calcium titanate, strontium titanate, zinc oxide, tin oxide, siliceous sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

More preferably, an inorganic compound such as dicalcium phosphate, calcium carbonate, titanium oxide, colloidal silica, or hydroxyapatite can be also used as the dispersing agent. Particularly, hydroxyapatite which is synthesized by reacting sodium phosphate with calcium chloride in a basic condition is preferred.

As a fine solid dispersing agent, it is possible to use microcrystal of low-molecular organic compounds or polymeric fine particles, that is, polystyrene and methacrylic esters and acrylic ester copolymers obtained by soap-free emulsion polymerization, suspension polymerization and dispersion polymerization, polymer particles obtained by polycondensation of silicone, benzoguanamine and nylon, and polymer particles of thermosetting resins.

Also, when a dispersing agent which is soluble in acid, such as calcium phosphate, or alkali, such as copolymers of (meth)acrylic acid is used as a fine solid dispersing agent, the fine solid dispersing agent is dissolved in base or acid such as hydrochloric acid or sodium hydroxide and washed with water to remove the fine solid dispersing agent from the toner particles which has been shaped. In addition, decomposition by an enzyme can be used.

(Dispersing Agent Combined Upon Emulsionization or Added Later)

Dispersing agents for use in the preparation of the toner of the present invention include anionic surfactants such as alkylbenzenesulfonic acid salts, α-olefin sulfonic acid salts and phosphoric acid esters; cationic surfactants such as amine salts, e.g., alkyl amine salts, amino-alcohol derivatives with fatty acids, polyamine derivatives with fatty acids and imidazoline, and quaternary ammonium type surfactants, e.g., alkyltrimethylammonium salts, dialkyldimethylammonium salts, alkyldimethylbenzyl ammonium salts, pyridinium salts, alkylisoquinolium salts, alkyldimethylammonium salts and benzethonium chloride; nonionic surfactants such as fatty acid amide derivatives and polyhydric alcohols; and amphoteric surfactants such as alanine, dodecyldi(aminoethyl)glycine, di(octylaminoethyl)glycine, and N-alkyl-N,N-dimethylammoniumbetaine.

When surfactants having a fluoroalkyl group are used, they can exert their effects in only very small amounts. Preferred anionic surfactants having a fluoroalkyl group include fluoroalkylcarboxylic acids having from 2 to 10 carbon atoms and their metal salts, perfluorooctanesulfonylglutamic acid disodium salt, 3-[omega-fluoroalkyl(C6-C11)oxy]-1-alkyl(C3-C4)sulfonic acid sodium salts, 3-[omega-fluoroalkanoyl(C6-C8)-N-ethylamino]-1-propanesulfonic acid sodium salts, fluoroalkyl(C11-C20)carboxylic acids and their metal salts, perfluoroalkylcarboxylic acids (C7-C13) and their metal salts, perfluoroalkyl(C4-C12)sulfonic acid and their metal salts, perfluorooctanesulfonic acid diethanolamide, N-propyl-N-(2-hydroxyethyl)perfluorooctanesulfonamide, perfluoroalkyl(C6-C10)sulfoneamidopropyl trimethylammonium salts, perfluoroalkyl(C6-C10)-N-ethylsulfonylglycine salts, and monoperfluoroalkyl(C6-C16)ethylphosphoric acid esters.

Tradenamed anionic surfactants having a perfluoroalkyl group include Surflon S-111, S-112 and S-113 (manufactured by Asahi Glass Co., Ltd.), Florard FC-93, Ec95, FC-98 and FC-129 (manufactured by Sumitomo 3M Ltd.), Unidine DS-101 and DS-102 (manufactured by Daikin Co., Ltd.), Megafac F-110, F-120, F-113, F-191, F-812 and F-833 (manufactured by Dainippon Ink and Chemicals, Inc.), Ektop EF-102, 103, 104, 105, 112, 123A, 123B, 306A, 501, 201 and 204 (manufactured by Tochem Products Co., Ltd.), and Phthargent F-100 and F-150 (manufactured by Neos co., Ltd.).

Cationic surfactants having a fluoroalkyl group include primary, secondary or tertiary aliphatic amine salts; aliphatic quaternary ammonium salts such as perfluoroalkyl(C6-C10) sulfonamidopropyltrimethylammonium salts; benzalkonium salts; benzethonium chloride; pyridinium salts; and imidazolinium salts. Tradenamed cationic surfactants include Surflon S-121 (Asahi Glass Co., Ltd.), Florard FC-135 (manufactured by Sumitomo 3M Ltd.), Unidine DS-202 (manufactured by Daikin Co.), Megafac F-150 and F-824 (Dainippon Ink and Chemicals Inc.), Ektop EF-132 (manufactured by Tochem Products Co., Ltd.), and Phthargent F-1300 (manufactured by Neos Co., Ltd.).

In addition, primary particles can be stabilized with polymer type protective colloids. Specific examples of such polymer type protective colloids include homopolymers and copolymers of the following compounds: acids such as acrylic acid, methacrylic acid, α-cyanoacrylic acid, α-cyanomethacrylic acid, itaconic acid, crotonic acid, fumaric acid, maleic acid, and maleic anhydride; (meth)acrylic monomers such as β-hydroxyethyl acrylate, β-hydroxyethyl methacrylate, β-hydroxypropyl acrylate, β-hydroxypropyl methacrylate, gamma.-hydroxypropyl acrylate, .gamma.-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylol acrylamide, and N-methylol methacrylamide; vinyl alcohol, ethers such as vinyl methyl ether, vinyl ethyl ether and vinyl propyl ether, and compounds having a carboxyl group such as vinylacetate, vinylpropionate and vinyl butyrate; amides such as acrylamide, methacrylamide, diacetoneacrylamide, and their methylol compounds; acid chloride compounds such as acrylic acid chloride, and methacrylic acid chloride; compounds having a nitrogen atom or a heterocyclic ring including a nitrogen atom such as vinyl pyridine, vinyl pyrrolidone, vinyl imidazole and ethylene imine; polyoxyethylene compounds such as polyoxyethylene, polyoxypropylene, polyoxyethylenealkylamine, polyoxypropylenealkylamine, polyoxyethylenealkylamide, polyoxypropylenealkylamide, polyoxyethylenenonylphenylether, polyoxyethylenelaurylphenylether, polyoxyethylenestearylphenylether, and polyoxyethylenenonylphenylether; and cellulose compounds such as methyl cellulose, hydroxyethyl cellulose, and hydroxypropyl cellulose. When using a dispersing agent, the dispersing agent may be deposited on the surface of the toner particles. However, it is preferable to wash out the dispersing agent after expansion and/or cross-linking reaction, in terms of the charging of the toner. When the prepolymer (A) and amines (B) are reacted in a water based media, expansion and/or cross linking reaction time is selected according to the reactivity by a structure of the isocyanate group contained in the prepolymer (A) and a combination of amines (B) and generally 10 minutes to 40 hours, preferably 2 hours to 24 hours. The reaction temperature is generally 0° C. to 150° C., preferably 40° C. to 98° C. As needed, a known catalyst may be used. Specifically, dibutyltin laurate and dioctyltin laurate are contained.

In order to remove the organic solvent from the emulsion-dispersing agent, the temperature of the entire system may be gradually raised to completely remove the organic solvent from said liquid droplets. When the dispersoid of solid fine particles attached to the surface of the dispersoid is treated with acid-alkali and the like to partly remove by dissolving the particles in advance, it can be allowed to regulate the shape.

Further, an emulsion dispersing agent may be sprayed in a drying atmosphere to completely remove the non-water soluble organic solvent from liquid droplets to form fine toner particles, followed by evaporation removal of the water-based dispersing agent. The drying atmosphere in which the Emulsion dispersing agent is sprayed may be air, nitrogen, carbon dioxide or exhaust gas which is heated to a certain temperature. Particularly various types of gaseous streams which have been heated to a temperature above the boiling point of the non-water soluble organic solvent with the highest boiling point would generally be employed. Short-term treatments using spray dryer, belt dryer, rotary kiln and the like can be used to obtain the desired product quality.

When the particle distribution in the emulsifying dispersion is wide and washing and drying steps are carried out under the wide particle distribution, the particles can be classified to provide the desired particle distribution.

The particles may be classified by use of cyclone, decanter or centrifugal separator in the dispersion state to remove the fine particles. Of course, it is possible to classify the particles in the state of powder after drying. However, to classify the particles in the dispersion is more efficient. The undesirable fine particles or coarse particles may be returned to the mixing process to be used in the formation of particles. The fine particles or coarse particles might be wetted.

Although the used dispersing agents is preferable to remove from the obtained dispersion, if possible, the said classification operation can be preferably carried out at the same time.

The toner particles obtained by the above-mentioned drying step can be mixed with fine particles of various agents such as a releasing agent, a charge controlling agent, a fluidity-imparting agent, and a colorant. Further, by the application of mechanical impact to the thus obtained mixture of particles, those fine particles of various agents can be fixedly deposited on the surface of the toner particles or uniformly blended with the toner particles on the surface thereof. Thus, the particles of various agents attached to the surface of the toner particles can be prevented from falling off.

To be more specific, there are the method of applying the impact to the mixed particles using a blade rotating at a high revolution, and the method of putting the mixed particles into an air stream flowing at a high speed, and making the particles come into collision and the obtained composite particles strike against a proper plate by accelerating the air stream. For example, there can be employed a commercially available system, "Ang mill"®, made by Hosokawa Micron Corporation; a system obtained by modifying "Impact Mill"®, made by Nippon Pnewmatic Mfg. Co., Ltd. by descending the air pressure for pulverizing; a system "Hybridization System"®, made by Nara Machinery Co., Ltd.; and a system "Kryptron System"®, made by Kawasaki Heavy Industries, Ltd.; and an automatic mortar.

(Manufacture of Dry Toner)

The dry toner can be prepared by the above-described method but it is not limited thereto.

In preparing the toner, inorganic fine particles such as fine hydrophobic silica powder mentioned earlier may be added to the toner prepared as described above in order to enhance the fluidity, preservability, developing property and transfer property of the toner. Mixing of the additive is performed using a generally employed powder mixer which is desirably provided with a jacket or the like to adjust the internal temperature. In order to change the hysteresis load imparted to the additive, the additive may be added in the course of the process or gradually. It is course, allowable to change the rotational speed, rolling speed, times and temperature of the mixer. A large load may, first, be exerted and a relatively small load may, then, be exerted, or vice versa.

The mixing facility that can be used may be a V-type mixer, locking mixer, Redige mixer, Nanter mixer, HENSCHEL MIXER, and the like.

In order to control the shape of the produced toner, for example, there is a method of melt-kneading a toner material comprising a toner binder and a colorant under a molten state, pulverizing the resulting mass and then, mechanically forming the fine particles into a spherical form by a hybridizer or mecanofusion, a method of obtaining a spherical toner, so called spray drying method, by dissolving and dispersing a toner material in a solvent wherein the toner binder is soluble, and removing the solvent by a spray drying apparatus, or a method of heating toner particles in an aqueous medium, but it is not limited to thereof.

(Other Additives)

As an additive to assistant flowability, developing ability and chargeability, fine particles of inorganic materials can be preferably employed. The primary particle diameter of the inorganic fine particles is preferably about 5 μm to about 2 μm, and more preferably about 5 μm to about 500 μm. The specific surface area of the inorganic particles, which is determined by the BET method, preferably ranges from about 20 to about 500 $m^2/g$. The content of the fine inorganic particles in the toner preferably ranges from about 0.01 to about 5% by weight, and more preferably from about 0.01 to about 2.0% by weight. Specific examples of such particles include silica, alumina, titanium oxide, barium titanate, magnesium titanate, calcium titanate, strontium titanate, zinc oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, silicon nitride and the like.

By subjecting these fluidizing agents to a surface treatment to improve the hydrophobic properties thereof, deterioration of the fluidity and the charge properties of the toner can be avoided even under high humidity conditions.

Suitable surface treating agents include silane coupling agents, silane coupling agents having a fluorinated alkyl group, organic titanate type coupling agents, aluminum type coupling agents, silicon oil, modified silicon oil and the like.

Cleaning property improving agents for use in the toner of the present invention include fatty acids and their metal salts such as stearic acid, zinc stearate and calcium stearate, and particulate polymers such as polymethyl methacrylate particles and polystyrene particles which are manufactured, for example, by the soap-free emulsion polymerization method. The polymer particles preferably have a relatively narrow particle distribution and a volume average size of 0.01 to 1 μm.

(Carrier for Two-Component Developing Agent)

When the toner of the present invention is used in a two-component developing agent, it is preferable to use the toner with a magnetic carrier and the ratio of the toner and the carrier is 1 to 10 weight part of toner per 100 weight part of a carrier. Examples of the magnetic carriers include those conventionally known to the art such as iron powder, ferrite power, magnetite powder, magnetic resin carrier and the like, having a particle size of 20 μm to 200 μm. Also, as a coating material, amino resins, such as a urea-formaldehyde resin, a melamine resin, a benzoguanamine resin, and a urea resin, polyamide resins, and epoxy resins are useful. In addition, polyvinyl resins, polyvinylidene resins, acrylic resins, polymethyl methacrylate resins, polyacrylonitrile resins, polyvinyl acetate resins, polyvinyl alcohol resins, polyvinyl butyral resins, polystyrene resins, such as polystyrene and styrene-acrylic copolymer resins; halogenated olefin resins, such as polyvinyl chloride; polyester resins, such as polyethylene terephthalate and polybutylene terephthalate; and polycarbonate resins, polyethylene resins, polyvinyl fluoride resins, polyvinylidene fluoride resins, polytrifluoroethylene resins, polyhexafluoropropylene resins, vinylidene fluoride-acrylic monomer copolymer resins, vinylidene fluoride-vinyl fluoride copolymer resins, fluoro-terpolymers such as a tetrafluoroethylene-vinylidene fluoride-non-fluorine monomer copolymer, silicone resins, and the like, can be used. As needed, electrically conductive powder may be used in the coating resin. The electrically conductive powder includes metal powder, carbon black, titanium oxide, tin oxide, zinc oxide, and the like. The powder preferably has an average particle diameter of not greater than 1 μm. Particles greater than 1 μm make resistance control difficult.

Also, the toner of the present invention may be used as a one-component magnetic toner or non-magnetic toner either of which uses a carrier.

The present invention will be explained in more detail by way of examples, which are not intended to be limiting of the present invention, in which all designations of parts indicate parts by weight, unless otherwise noted.

EXAMPLES AND COMPARATIVE EXAMPLES

Test I

By varying the amount of an organic solvent added to the aqueous medium and conditions for the treatment before removal of the solvent, toners having various average circularities and fine particle contents were prepared and evaluated.

(Synthesis of a Toner Binder)

A reaction vessel equipped with a tubular cooler, a stirrer and a nitrogen introducing tube was charged with 724 parts of a bisphenol A ethylene oxide (2 mols) adduct, 276 parts of terephthalic acid and 2 parts of dibutyltin oxide and the mixture was polycondense-reacted at 230° C. under normal pressure for 8 hours and was further reacted under a vacuum of 10 mmHg to 15 mmHg for 5 hours to obtain a non-modified polyester (a) having a peak molecular weight of 5300. 100 parts of the resin was dissolved in 100 parts of ethyl acetate and mixed to obtain an ethyl acetate solution of a toner binder. A part of the ethyl acetate solution was dried under reduced pressure to isolate the toner binder. The Tg of the toner binder were 62° C. The acid value of was 10

(Manufacture of a Toner)

A closed container was charged with 200 parts of the ethyl acetate solution of the above toner binder, 5 parts of carnauba wax, 4 parts of copper phthalocyanine blue pigment, 1 part of zinc di-t-butyl salicylate and zirconia beads (5 mm ϕ) were ball milled for 24 hours to obtain a toner composition. A part from this, in another beaker, was charged 600 parts of ion exchange water, X parts of methyl ethyl ketone, 60 parts of tricalcium phosphate, 0.3 parts of sodium dodecylbenzene sulfonate and the mixture were added and uniformly dissolved. The internal temperature of the beaker was maintained at 20° C., and the above toner composition was added to the mixed solution while stirring at 12000 rpm for 3 minutes by using a TK-type homomixer (a product of Tokushu Kika Kogyo Co., Ltd.). The mixture solution was then poured into a flask equipped with a poker and a thermometer. Thereafter, 0.3 parts of lauryl sulfate sodium and Y parts of 35% condensed hydrochloric acid were added, followed by stirring and dissolving for 30 minutes at room temperature. The solvent was next removed at 30° C. and under 50 mmHg of the reduced pressure. The dispersions were analyzed by gas chromatography. It was found that remaining ethyl acetate was 50 ppm to the toner particles. 120 parts of 35% condensed hydrochloric acid was added, dicalcium phosphate was dissolved, followed by filtering. The resulting filter cakes were redispersed in distilled water and filtered. This process was repeated 3 times. The dispersions were dried at 40° C. under reduced pressure for 24 hours to obtain toner particles. Finally, 100 parts of the toner particles were mixed with 0.5 parts of hydrophobic silica, 0.5 parts of dehydrated titanium oxide in a HENSCHEL MIXER to obtain the toner of the present invention. Properties of various toners obtained through using X parts of the methyl ethyl ketone and Y parts of the 35% condensed hydrochloric acid are shown in Table 1. The results of evaluation of the toners are shown in Table 2.

TABLE 1

Manufacture condition and properties of toners

| Toner No. | X parts | Y parts | Average sphericity | Content of fine particles of 2 μm or less (%) | Contraction Rate | Dv | Dv/Dn |
|---|---|---|---|---|---|---|---|
| Comp. Toner A | 30 | 0 | 0.912 | 14 | 52 | 6.5 | 1.14 |
| Comp. Toner B | 30 | 10 | 0.924 | 15 | 52 | 6.6 | 1.15 |
| Comp. Toner C | 0 | 20 | 0.931 | 25 | 52 | 6.2 | 1.19 |
| Toner of the present invention D | 30 | 20 | 0.938 | 12 | 52 | 6.5 | 1.14 |
| Toner of the present invention E | 60 | 20 | 0.933 | 7 | 52 | 6.8 | 1.10 |
| Comp. Toner F | 0 | 30 | 0.956 | 24 | 52 | 6.1 | 1.18 |
| Toner of the present invention G | 30 | 30 | 0.953 | 17 | 52 | 6.4 | 1.14 |
| Toner of the present invention H | 60 | 30 | 0.959 | 2 | 52 | 6.9 | 1.11 |
| Comp. Toner I | 0 | 40 | 0.982 | 22 | 52 | 6.3 | 1.16 |
| Toner of the present invention J | 30 | 40 | 0.983 | 17 | 52 | 6.5 | 1.15 |
| Toner of the present invention K | 60 | 40 | 0.986 | 7 | 52 | 6.8 | 1.10 |
| Comp. Toner L | 30 | 50 | 0.992 | 14 | 52 | 6.6 | 1.16 |
| Comp. Toner M | 30 | 60 | 0.998 | 18 | 52 | 6.4 | 1.15 |

TABLE 2

| Toner No. | Evaluation of various toners: Initial reproducibility of fine line | Reproducibility after running | Cleaning property |
|---|---|---|---|
| Comp. Toner A | X | Δ | ◎ |
| Comp. Toner B | Δ | Δ | ◎ |
| Comp. Toner C | ○ | X | ○ |
| Toner of the present invention D | ○ | ○ | ○ |
| Toner of the present invention E | ○ | ◎ | ○ |
| Comp. Toner F | ○ | X | ○ |
| Toner of the present invention G | ○ | ○ | ○ |
| Toner of the present invention H | ○ | ◎ | ○ |
| Comp. Toner I | ◎ | Δ | ○ |
| Toner of the present invention J | ◎ | ○ | ○ |
| Toner of the present invention K | ◎ | ◎ | ○ |
| Comp. Toner L | ◎ | ○ | X |
| Comp. Toner M | ◎ | ○ | X |

Therefore, it is noted that the toner of the present invention is excellent in a fine line reproducibility at the initial stage, the fine line reproducibility and cleaning property after running. If the average sphericity exceeds the range of the present invention, the cleaning property deteriorates. In contrast, when the average sphericity is far smaller than the range of the present invention, the fine line reproducibility at the initial stage deteriorates. When the content of the fine particles having the diameter of 2 μm exceeds the range of the present invention, both the fine line reproducibility after running and the durability deteriorate.

(Image Evaluation)

5 weight parts of the produced color toner and 95 weight parts of a carrier described later were mixed in a blender for 10 minutes to manufacture a developer.

(Carrier)

core: spherical ferrite particles having an average particle diameter of 50 μm.

material for coating components: silicone resin in which amino silane coupling agent is dispersed.

An amino silane coupling agent and silicone resin were dispersed in toluene. After preparing the dispersions, the dispersions were coated on the core by spray coating in a state of heating. After baking and cooling, the average thickness of the resin coating became 0.2 μm.

The developer was manufactured so as to have a charge quantity of about 15 to 25 (μc/g) in an absolute value by controlling the stirring time and speed in order that the toner has sufficient developing property and that toner deposition on the background of an image due to a reversely charged toner is prevented.

The fine line reproducibility was attained by installing the developer in a full color copier, PRETER 550, produced by Ricoh Co., Ltd., and a running test was performed using 6000 paper, produced by Ricoh Co., with an image occupancy of 7%. The 10th image at the initial stage and the 30000th image obtained in the running test were compared with each other and were observed under an optical microscope at 100 times magnification. Line omission in the images was evaluated according to four grades.

The cleaning property was evaluated after 30000 images were continuously produced. 10 sheets of full-color solid images were continuously produced and the printing was stopped during printing the 10th sheet. The toner after the cleaning blade on the photoconductor was transferred to a tape and the contamination degree of the tape was evaluated according to four grades.

The four grades are ◎>○>Δ>X according to the image quality. The grade X refers to an level which cannot be used in a commercial product.

The above-mentioned results demonstrated that the toners (toner D, E, G, H, J and K) having an average sphericity of 0.93 to 0.99 and a content of fine particles whose particle diameter is 2 μm or less of 20% by number or less shows good fine line reproducibility and cleaning property.

Test II

Effects of contraction rate, particle diameter, particle distribution and toner formation on image quality were precisely researched.

Example II-1

Toner H described in Table 1 refers to those obtained in Example II-1. By diversely changing the manufacture conditions, effects of contraction rate, particle diameter, particle distribution and toner formation on image quality were observed.

Example II-2

210 parts of toner compositions obtained in Example II-1 after ball milling dispersion was diluted in 576 parts of ethyl acetate. 210 parts of the diluted dispersing element was formed into fine particles after emulsifying to obtain particles. Thereafter, the toner of the present invention was prepared in the same way as in Example II-1.

Example II-3

350 parts of the toner composition obtained in Example II after ball milling was concentrated to 210 parts in an evaporator. The concentrated 210 parts of dispersing element was formed into fine particles after emulsifying. Thereafter, the toner of the present invention was prepared in the same way as in Example II-1.

Example II-4

210 parts of toner compositions obtained in Example II-1 after ball milling dispersion was diluted in 1165 parts of ethyl acetate. 210 parts of the diluted dispersing element was formed into fine particles after emulsifying to obtain particles. Thereafter, the toner of the present invention was prepared in the same way as in Example II-1.

Example II-5

368 parts of the toner composition obtained in Example II-1 after ball milling was concentrated to 210 parts in an evaporator. The concentrated 210 parts of dispersing element was formed into fine particles after emulsifying. Thereafter, the toner of the present invention was prepared in the same way as in Example II-1.

Example II-6

The toner obtained in Example II-1 was classified by an air flow classifier to obtain a toner of the present invention having an extremely narrow particle distribution.

Example II-7

The toner of the present invention was prepared in the same way as in Example II-1 except that emulsification was performed by using an emulsifer, TK fillmix FM30-50 (made by Tokushu Kika Kogyo Co. Ltd.), at 15000 rpm.

Example II-8

The toner of the present invention was prepared in the same way as in Example II-1, except that the amount of sodium dodecyl benzene sulfonate, which was used for preparing a cooling medium of Example II-1, was altered to 0.2 parts.

Example II-9

The toner of the present invention was prepared in the same way as in Example II-1, except that the amount of sodium dodecyl benzene sulfonate, which was used for preparing a cooling medium of Example II-1, was altered to 0.1 parts.

Example II-10

The toner of the present invention was prepared in the same way as in Example II-1, except that sodium lauryl sulfate added after emulsification was not used before the process for removing volatile components.

Example II-11

The toner of the present invention was prepared in the same way as in Example II-1, except that 0.1 parts of sodium lauryl sulfate was added after emulsification, that a toner component was stirred and dissolved at room temperature for 30 minutes and that the process for removing volatile components was then carried out.

Example II-12

The toner of the present invention was prepared in the same way as in Example II-1, except that 0.5 parts of sodium lauryl sulfate was added after emulsification, that a toner component was stirred and dissolved at room temperature for 30 minutes and that the process for removing volatile components was then carried out.

Example II-13

The toner of the present invention was prepared in the same way as in Example II-1, except that 0.5 parts of sodium lauryl sulfate was added after emulsification, that the toner was stirred and dissolved at room temperature for 30 minutes, and that the process for removing volatile components was then carried out.

Properties and image evaluation of the obtained toner are shown in Table 1. The contraction rate was calculated from the amount of ethyl acetate in the oil phase, Dv refers to the volume average particle diameter (μm) and Dv/Dn refers to the ratio of volume average particle diameter to number average particle diameter.

TABLE 3

Results of evaluation of the toners of Test II

| No | Contraction rate | Dv | Dv/Dn | Sphericity | 2 μm or less (%) | Initial fine line reproducibility | Cleaning property |
|---|---|---|---|---|---|---|---|
| Ex. II-1 | 52 | 6.9 | 1.11 | 0.959 | 2 | ◎ | ◎ |
| Ex. II-2 | 86 | 3.3 | 1.14 | 0.932 | 12 | ◎ | Δ |
| Ex. II-3 | 13 | 9.6 | 1.19 | 0.986 | 3 | Δ | ◎ |
| Ex. II-4 | 92 | 3.1 | 1.15 | 0.930 | 15 | ◎ | Δ |
| Ex. II-5 | 8 | 9.3 | 1.24 | 0.990 | 6 | Δ | Δ |
| Ex. II-6 | 52 | 6.3 | 1.10 | 0.965 | 3 | ◎ | Δ |
| Ex. II-7 | 52 | 6.4 | 1.12 | 0.970 | 2 | ◎ | ○ |
| Ex. II-8 | 52 | 6.5 | 1.24 | 0.975 | 7 | ○ | ○ |
| Ex. II-9 | 52 | 6.7 | 1.25 | 0.970 | 8 | Δ | Δ |
| Ex. II-10 | 52 | 6.3 | 1.17 | 0.931 | 5 | Δ | ◎ |
| Ex. II-11 | 52 | 6.5 | 1.15 | 0.932 | 4 | ○ | ◎ |
| Ex. II-12 | 52 | 6.5 | 1.16 | 0.987 | 6 | ◎ | Δ |
| Ex. II-13 | 52 | 6.1 | 1.21 | 0.989 | 9 | ◎ | Δ |

From the above results, it is noted that when the contraction rate falls in the range based on the method for producing the dry toner of the present invention, proper particle diameter and particle distribution can be obtained. When the average particle diameter and particle distribution fall in the preferred range, a dry toner with good fine line reproducibility and cleaning property can be obtained.

Test III

The effect of using modified polyester as a toner binder was researched.

(Synthesis of Modified Polyester 1)

In a reaction vessel equipped with a tubular cooler, a stirrer and a nitrogen introducing tube, 724 parts of a bisphenol A ethylene oxide (2 mols) adduct, 276 parts of isophthalic acid, and 2 parts of dibutylin oxide were added. The resulting mixture was reacted at 230° C. under normal pressure for 8 hours and was further reacted under a reduced pressure of 10 mmHg to 15 mmHg for 5 hours. After cooling down to 160° C., 32 parts of anhydrous phthalic acid was added and reacted for 2 hours. Subsequently, the resulting mixture was cooled to 80° C. and 188 parts of isophorone diisocyanate was added and reacted for 2 hours. A prepolymer (1) which contains an isocyanate group was hence obtained. Thereafter, 267 parts of the prepolymer (1) was reacted with 14 parts isophorone diamine at 50° C. for 2 hours. The resulting solution distilled and removed ethyl acetate to obtain urea-modified polyester (1) having a weight-average molecular weight of 64000.

(Synthesis of Modified Polyester 2)

In a reaction vessel equipped with a tubular cooler, a stirrer and a nitrogen introducing tube, 724 parts of a bisphenol A ethylene oxide (2 mols) adduct, 276 parts of isophthalic acid, 70 parts of boletic acid, and 2 parts of dibutylin oxide were added. The resulting mixture was reacted at 230° C. under normal pressure for 8 hours and was further reacted under a reduced pressure of 10 mmHg to 15 mmHg for 5 hours. After cooling down to 160° C., 32 parts of anhydrous phthalic acid was added and reacted for 2 hours. Subsequently, the resulting mixture was cooled to 80° C. Thereafter, 200 parts of styrene, 1 part of benzoyl peroxide, and 0.5 parts of dimethyl aniline were added. The mixture was reacted for 2 hours. The resulting mixture distilled and removed ethyl acetate to obtain polystyrene graft modified polyester (2) having a weight-average molecular weight of 92000.

(Manufacture of Toner Binder 3)

30 parts of urea-modified polyester (1) and 970 parts of non-modified polyester (a) were added and dissolved in 2000 parts of a mixed solvent of ethyl acetate/MEK (1/1), and then were mixed to obtain the ethyl acetate/MEK solution of the toner binder (3). By partially drying under reduced pressure, the toner binder (3) was isolated.

(Manufacture of Toner Binder 4)

500 parts of urea-modified polyester (1) and 500 parts of non-modified polyester (a) were added and dissolved in 2000 parts of a mixed solvent of ethyl acetate/MEK (1/1), and then were mixed to obtain the ethyl acetate/MEK solution of the toner binder (4). By partially drying under reduced pressure, the toner binder (4) was isolated.

(Manufacture of Toner Binder 5)

750 parts of urea-modified polyester (1) and 250 parts of non-modified polyester (a) were added and dissolved in 2000 parts of a mixed solvent of ethyl acetate/MEK (1/1), and then were mixed to obtain the ethyl acetate/MEK solution of the toner binder (5). By partially drying under reduced pressure, the toner binder (5) was isolated.

(Manufacture of Toner Binder 6)

850 parts of urea-modified polyester (1) and 150 parts of non-modified polyester (a) were added and dissolved in 2000 parts of a mixed solvent of ethyl acetate/MEK (1/1), and then were mixed to obtain the ethyl acetate/MEK solution of the toner binder (6). By partially drying under reduced pressure, the toner binder (6) was isolated.

(Synthesis of Toner Binder 7)

924 parts of a bisphenol A ethylene oxide (2 mols) adduct and 276 parts of terephthalic acid were polycondense-reacted at 230° C. under normal pressure for 8 hours and further under reduced pressure of 10 mmHg to 15 mmHg for 5 hours to obtain non-modified polyester (b) having a peak molecular weight of 5000. 100 parts of urea-modified polyester (1) and 900 parts of non-modified polyester (b) were added and dissolved in 2000 parts of a mixed solvent of ethyl acetate/MEK (1/1), and then were mixed to obtain the ethyl acetate/MEK solution of the toner binder (7). By partially drying under reduced pressure, the toner binder (7) was isolated. The acid value was 0.5.

(Synthesis of Toner Binder 8)

824 parts of a bisphenol A ethylene oxide (2 mols) adduct and 276 parts of terephthalic acid were polycondense-reacted at 230° C. under normal pressure for 8 hours and was further reacted under reduced pressure of 10 mmHg to 15 mmHg for 5 hours to obtain non-modified polyester (c) having a peak molecular weight of 5000. 100 parts of urea-modified polyester (1) and 900 parts of non-modified polyester (c) were added and dissolved in 2000 parts of a mixed solvent of ethyl acetate/MEK (1/1), and then were mixed to obtain the ethyl acetate/MEK solution of the toner binder (8). By partially drying under reduced pressure, the toner binder (8) was isolated. The acid value was 2.

(Synthesis of Toner Binder 9)

724 parts of a bisphenol A ethylene oxide (2 mols) adduct and 276 parts of terephthalic acid were polycondense-reacted at 230° C. under normal pressure for 8 hours and was further reacted under reduced pressure of 10 mmHg to 15 mmHg for 5 hours to obtain non-modified polyester (d) having a peak molecular weight of 5000. 100 parts of urea-modified polyester (1) and 900 parts of non-modified polyester (d) were added and dissolved in 2000 parts of a mixed solvent of ethyl acetate/MEK (1/1), and then were mixed to obtain the ethyl acetate/MEK solution of the toner binder (9). By partially drying under reduced pressure, the toner binder (9) was isolated. The acid value was 25.

(Synthesis of Toner Binder 10)

724 parts of a bisphenol A ethylene oxide (2 mols) adduct and 276 parts of terephthalic acid were polycondense-reacted at 230° C. under normal pressure for 8 hours and was further reacted under reduced pressure of 10 mmHg to 15 mmHg for 5 hours to obtain non-modified polyester (e) having a peak molecular weight of 5000. 100 parts of urea-modified polyester (1) and 900 parts of non-modified polyester (e) were added and dissolved in 2000 parts of a mixed solvent of ethyl acetate/MEK (1/1), and then were mixed to obtain the ethyl acetate/MEK solution of the toner binder (10). By partially drying under reduced pressure, the toner binder (10) was isolated. The acid value was 25.

(Synthesis of Toner Binder 11)

724 parts of a bisphenol A ethylene oxide (2 mols) adduct and 276 parts of terephthalic acid were polycondense-reacted at 230° C. under normal pressure for 2 hours and was further reacted under reduced pressure of 10 mmHg to 15 mmHg for 5 hours to obtain non-modified polyester (f) having a peak molecular weight of 1000. 100 parts of urea-modified polyester (1) and 900 parts of non-modified polyester (f) were added and dissolved in 2000 parts of a mixed solvent of ethyl acetate/MEK (1/1), and then were mixed to obtain the ethyl acetate/MEK solution of the toner binder (11). By partially drying under reduced pressure, the toner binder (11) was isolated. The Tg was 25° C.

(Synthesis of Toner Binder 12)

724 parts of a bisphenol A ethylene oxide (2 mols) adduct and 276 parts of terephthalic acid were polycondense-reacted at 230° C. under normal pressure for 4 hours and was further reacted under reduced pressure of 10 mmHg to 15 mmHg for 5 hours to obtain non-modified polyester (g) having a peak molecular weight of 1000. 100 parts of urea-modified polyester (1) and 900 parts of non-modified polyester (g) were added and dissolved in 2000 parts of a mixed solvent of ethyl acetate/MEK (1/1), and then were mixed to obtain the ethyl acetate/MEK solution of the toner binder (12). By partially drying under reduced pressure, the toner binder (12) was isolated. The Tg was 52° C.

(Synthesis of Toner Binder 13)

724 parts of a bisphenol A ethylene oxide (2 mols) adduct and 276 parts of terephthalic acid were polycondense-reacted at 230° C. under normal pressure for 10 hours and was further reacted under reduced pressure of 10 mmHg to 15 mmHg for 5 hours to obtain non-modified polyester (h) having a peak molecular weight of 30000. 100 parts of urea-modified polyester (1) and 900 parts of non-modified polyester (h) were added and dissolved in 2000 parts of a mixed solvent of ethyl acetate/MEK (1/1), and then were mixed to obtain the ethyl acetate/MEK solution of the toner binder (13). By partially drying under reduced pressure, the toner binder (13) was isolated. The Tg was 69° C.

(Synthesis of Toner Binder 14)

724 parts of a bisphenol A ethylene oxide (2 mols) adduct and 276 parts of terephthalic acid were polycondense-reacted at 230° C. under normal pressure for 12 hours and was further reacted under reduced pressure of 10 mmHg to 15 mmHg for 5 hours to obtain non-modified polyester (i) having a peak molecular weight of 30000. 100 parts of urea-modified polyester (1) and 900 parts of non-modified polyester (i) were added and dissolved in 2000 parts of a mixed solvent of ethyl acetate/MEK (1/1), and then were mixed to obtain the ethyl acetate/MEK solution of the toner binder (14). By partially drying under reduced pressure, the toner binder (14) was isolated. The Tg was 73° C.

Example (III-1 to III-14)

(Manufacture of Toner)

By following the same procedure for the toner G of the present invention in Test I, toners were prepared. That is, a closed pot was charged with the toner binder 100 parts, as the composition shown in Table 2, the solution 200 parts made of ethyl acetate solution 100 parts, 5 parts of carnauba wax, 4 parts of copper phthalocyanine blue pigment, 1 part of zinc di-t-butyl salicylate and zirconia beads (5 mm ϕ) were ball milled for 24 hours to obtain a toner composition. Apart from this, another beaker was charged with 600 parts of ion exchange water, 30 parts of methyl ethyl ketone, 60 parts of tricalcium phosphate, 0.3 parts of sodium dodecylbenzene sulfonate and the mixture was uniformly dissolved. The temperature was maintained at 20° C. and the above toner material solution was added to the mixed solution while stirring at 12000 rpm by using a TK-type homomixer (made by Tokushu Kika Kogyo Co.,Ltd.) for 3 minutes. The mixture solution was then poured into a flask equipped with a poker and a thermometer and 0.3 parts of lauryl sulfate sodium and 30 parts of 35% condensed hydrochloric acid were added, followed by stirring for 30 minutes at room temperature. Then, the solvent was removed at 30° C. and 50 mmHg under reduced pressure. The dispersions were analyzed by gas chromatography and it was found that remaining ethyl acetate was 50 ppm to the toner particles. 120 parts of 35% condensed hydrochloric acid was added, dicalcium phosphate was dissolved, followed by filtering. The resulting filter cakes were redispersed in distilled water and filtered. This process was repeated 3 times. The dispersions were dried at 40° C. under reduced pressure for 24 hours to obtain toner particles. Then, 100 parts of the toner particles were mixed with 0.5 parts of hydrophobic silica, 0.5 parts of dehydrated titanium oxide in a HENSCHEL MIXER to obtain the toner of the present invention. Compositions and properties of various toner binders are shown in Table 4 and the results of evaluation of the toners using the toner binders are shown in Table 5.

TABLE 4

| No | Modified PES(i) | PES(ii) | (i)/(ii) | Mp | Mw/Mn | Acid value | Tg |
|---|---|---|---|---|---|---|---|
| Ex. III-1 | (1) | (a) | 10/90 | 5000 | 3 | 10 | 62 |
| Ex. III-2 | (2) | (a) | 20/80 | 5000 | 3.5 | 10 | 65 |
| Ex. III-3 | (1) | (a) | 3/97 | 5000 | 2 | 10 | 62 |
| Ex. III-4 | (1) | (a) | 50/50 | 5000 | 3.5 | 10 | 62 |
| Ex. III-5 | (1) | (a) | 75/25 | 5000 | 4.5 | 10 | 62 |
| Ex. III-6 | (1) | (a) | 85/15 | 5000 | 5 | 10 | 62 |
| Ex. III-7 | (1) | (b) | 10/90 | 5000 | 3 | 0.5 | 62 |
| Ex. III-8 | (1) | (c) | 10/90 | 5000 | 3 | 2 | 62 |
| Ex. III-9 | (1) | (d) | 10/90 | 5000 | 3 | 25 | 62 |
| Ex. III-10 | (1) | (e) | 10/90 | 5000 | 3 | 35 | 62 |
| Ex. III-11 | (1) | (f) | 10/90 | 1000 | 4.5 | 10 | 45 |
| Ex. III-12 | (1) | (g) | 10/90 | 2000 | 4 | 10 | 52 |
| Ex. III-13 | (1) | (h) | 10/90 | 20000 | 2.5 | 10 | 69 |
| Ex. III-14 | (1) | (i) | 10/90 | 30000 | 2 | 10 | 73 |
| Toner of the present invention G | — | (a) | 0/100 | 5000 | 3 | 10 | 57 |

Mp refers to molecular weight peak,
Mw/Mn refers to the rate of weight-average molecular weight to number average molecular weight and
Tg refers to glass transition temperature (° C.).

TABLE 5

| No | Average sphericity | Content of 2 μm or less (%) | Flowidity | Storage Stability Under Heat | Minimum Fixing Temperature (° C.) | HOT (° C.) | GLOSS (° C.) |
|---|---|---|---|---|---|---|---|
| Ex. 1 | 0.962 | 10 | ○ | ○ | 140 | 220 | 150 |
| Ex. 2 | 0.954 | 16 | ◎ | ○ | 140 | 225 | 150 |
| Ex. 3 | 0.961 | 12 | Δ | Δ | 135 | 180 | 145 |
| Ex. 4 | 0.955 | 8 | ○ | ○ | 145 | 210 | 160 |
| Ex. 5 | 0.953 | 15 | ○ | ○ | 150 | 225 | 180 |
| Ex. 6 | 0.961 | 17 | ○ | ◎ | 160 | 240 | 180 |
| Ex. 7 | 0.966 | 9 | Δ | ○ | 145 | 220 | 150 |
| Ex. 8 | 0.954 | 8 | ○ | ○ | 140 | 220 | 150 |
| Ex. 9 | 0.968 | 15 | ○ | ○ | 140 | 220 | 150 |
| Ex. 10 | 0.953 | 13 | ○ | Δ | 135 | 220 | 145 |

TABLE 5-continued

| No | Average sphericity | Content of 2 μm or less (%) | Flowidity | Storage Stability Under Heat | Minimum Fixing Temperature (° C.) | HOT (° C.) | GLOSS (° C.) |
|---|---|---|---|---|---|---|---|
| Ex. 11 | 0.961 | 14 | ○ | X | 130 | 200 | 140 |
| Ex. 12 | 0.946 | 8 | ○ | ○ | 140 | 210 | 145 |
| Ex. 13 | 0.962 | 7 | ○ | ○ | 150 | 220 | 160 |
| Ex. 14 | 0.958 | 16 | ◎ | ◎ | 160 | 230 | 170 |
| Toner of the present invention G | 0.953 | 17 | Δ | X | 140 | 170 | 145 |

From the above results, toners having an acid value, molecular weight-peak, glass transient temperature in the preferred range of the present invention and prepared using a proper amount of modified polyester are excellent in image-fixing properties at low temperature and hot offset resistance as well as effects of the present invention and further, a high glossiness at a low temperature.

[Method of Evaluation]

Powder Fluidity

A powder tester manufactured by Hosokawa Micron Co., Ltd. was used to measure the static apparent density. The better the fluidity of the toner is, the larger the static apparent density is.

X: less than 0.25

Δ: 0.25-0.30

○: 0.30-0.35

◎: more than 0.35

Storage Stability Under Heat

The toner was put through 42 mesh sieve for 2 minutes after it was stored at 50° C. for 8 hours to measure the ratio of a toner residue left on the sieve, the ratio being defined as the storage stability under heat. The better the storage stability under heat is, the smaller the residual ratio of the toner is.

X: more than 30%

Δ: 20-30%

○: 10-20%

◎: less than 10%

Minimum Fixing Temperature (MFT)

As for fixing roller, a modification of MF-200 copying machine manufactured by Ricoh Co., Ltd., which utilizes TEFLON roller, was used. Then, Type 6200 paper of Ricoh was set on the apparatus and copy test was performed thereon. The fixing roll temperature at which the residual rate of the image density, after the fixed image was rubbed by a pat, was 70% or more was adopted as the minimum fixing temperature.

Hot Offset Generation Temperature (HOT)

An evaluation by fixing was carried out in the above MFT to determine whether or not a hot offset to the fixed image was present by visual observation. The fixing roll temperature at which a hot offset occurred was adopted as the hot offset generation temperature.

Glossiness Appearance Temperature (GLOSS)

Image-fixing properties was measured using a commercially available copier (PRETER 550; manufactured by Ricoh Co., Ltd.). The glossiness appearance temperature refers to the temperature of the fixing roll, at which 60 gloss of the fixed image is 10% or more.

As described in the above, the dry toner of the present invention has a shape suitable for high quality image, transferring property, cleaning property and good durability in practical application.

Also, according to the method for producing a toner of the present invention it is possible to provide a toner which satisfies high quality image, transferring property, cleaning property by using a dispersing agent of solid fine particles in an aqueous medium to maintain a desired particle diameter and particle distribution through volume contraction with a contraction rate of 10% to 90%.

Further, the toner can provide simultaneously glossiness and releasing property as a full color toner.

What is claimed is:

1. A method for manufacturing a dry toner, comprising:

dispersing in an aqueous medium comprising water and a water-soluble organic solvent, a toner composition contained in an organic solvent by using fine solid dispersing agents; and contracting volume of the dispersed toner composition, wherein the dry toner comprises fine particles having an average sphericity of 0.93 to 0.99;

the content of the fine particles having a particle diameter of 2 μm or less in the dry toner is 20% by number or less; and the fine solid dispersing agents are partially removed during the contracting.

2. A method for manufacturing a dry toner according to claim 1, wherein the toner composition comprises a modified polyester.

3. A method for manufacturing a dry toner according to claim 1, wherein the toner composition comprises a modified polyester having either a urethane bond or a urea bond and formed from a prepolymer containing an isocyanate group that is reacted with amines during the dispersing in the aqueous medium.

4. A method for manufacturing a dry toner according to claim 1, wherein the average sphericity of the fine particles is 0.95 to 0.98.

5. A method for manufacturing a dry toner according to claim 1, wherein the content of fine particles having a particle diameter of 2 μm or less is 10% by number or less.

6. A method for manufacturing a dry toner according to claim 1, wherein a volume average particle diameter of the fine particles is 3 μm to 10 μm, and a ratio of the volume average particle diameter to the number average particle diameter is 1.10 to 1.25.

7. A method for manufacturing a dry toner according to claim 6, wherein the volume average particle diameter of the fine particles is 4 μm to 7 μm, and a ratio of the volume average particle diameter to the number average particle diameter is 1.15 to 1.20.

8. A method for manufacturing a dry toner according to claim 1, wherein the dry toner comprises a colorant and a toner binder, and the toner binder contains a modified polyester and a non-modified polyester, and a weight ratio of the modified polyester to the non-modified polyester is 1/99 to 80/20.

9. A method for manufacturing a dry toner according to claim 8, wherein the modified polyester has either a urethane bond or a urea bond.

10. A method for manufacturing a dry toner according to claim 8, wherein the toner binder has a peak molecular weight of 1,000 to 30,000.

11. A method for manufacturing a dry toner according to claim 8, wherein the toner binder has an acid value of 1 mg to 30 mg KOH.

12. A method for manufacturing a dry toner according to claim 8, wherein the toner binder has a glass transition point (Tg) of 50° C. to 70° C.

13. A method for manufacturing a dry toner according to claim 1, wherein the contracting volume is carried out at a contraction rate of 10% to 90%.

14. A method for manufacturing a dry toner according to claim 13, wherein a volume average particle diameter of the fine particles is 3μm to 10 μm, and a ratio of the volume average particle diameter to a number average particle diameter is 1.10 to 1.25.

15. A method for manufacturing a dry toner according to claim 13, wherein the contraction rate is 30% to 70%.

16. A method for manufacturing a dry toner according to claim 15, wherein a volume average particle diameter of the fine particles is 4 μm to 7 μm, and ratio of the volume average particle diameter to a number average particle diameter is 1.15 to 1.20.

* * * * *